US008847941B2

(12) United States Patent
Tanaka et al.

(10) Patent No.: US 8,847,941 B2
(45) Date of Patent: Sep. 30, 2014

(54) DISPLAY DEVICE AND DISPLAY CONTROL DEVICE

(75) Inventors: Shinya Tanaka, Kobe (JP); Shogo Tanaka, Kobe (JP); Atsushi Hatagaki, Kobe (JP); Tomoyuki Nakamura, Kobe (JP); Yasushi Tani, Kobe (JP); Atsushi Mino, Kobe (JP); Satoshi Harumoto, Kobe (JP); Naotoshi Miyamoto, Kobe (JP); Minoru Maehata, Kobe (JP)

(73) Assignee: Fujitsu Ten Limited, Kobe (JP)

( * ) Notice: Subject to any disclaimer, the term of this patent is extended or adjusted under 35 U.S.C. 154(b) by 771 days.

(21) Appl. No.: 13/121,728

(22) PCT Filed: Sep. 4, 2009

(86) PCT No.: PCT/JP2009/065503
§ 371 (c)(1),
(2), (4) Date: Jun. 14, 2011

(87) PCT Pub. No.: WO2010/038578
PCT Pub. Date: Apr. 8, 2010

(65) Prior Publication Data

US 2011/0234574 A1 Sep. 29, 2011

(30) Foreign Application Priority Data

Sep. 30, 2008 (JP) ..... 2008-254748
Feb. 3, 2009 (JP) ..... 2009-023116

(51) Int. Cl.

| | |
|---|---|
| ***G06F 3/038*** | (2013.01) |
| ***G09G 3/20*** | (2006.01) |
| *G09G 3/32* | (2006.01) |
| *G09G 3/34* | (2006.01) |
| *G09G 3/36* | (2006.01) |

(52) U.S. Cl.

CPC ..... *G09G 3/2096* (2013.01); *G09G 3/3208* (2013.01); *G09G 2330/08* (2013.01); *G09G 3/3406* (2013.01); *G09G 2310/0275* (2013.01); *G09G 3/36* (2013.01); *G09G 2310/08* (2013.01); *G09G 3/3666* (2013.01)

USPC ..... 345/211

(58) Field of Classification Search
None
See application file for complete search history.

(56) References Cited

U.S. PATENT DOCUMENTS 7,123,252 B1 10/2006 Baek
2001/0052887 A1* 12/2001 Tsutsui et al. ..... 345/87

(Continued)

FOREIGN PATENT DOCUMENTS

JP A-07-253762 10/1995
JP A-08-204207 8/1996

(Continued)

OTHER PUBLICATIONS

Aug. 20, 2013 Office Action issued in Japanese Application No. 2009-023116 (with partial translation).

(Continued)

*Primary Examiner* — Joseph Haley
*Assistant Examiner* — Emily Frank
(74) *Attorney, Agent, or Firm* — Oliff PLC

(57) ABSTRACT

A display that includes a display panel, a controller controlling the display panel, and drivers for driving the display panel, the drivers including a most previous stage driver supplying a data signal from a controller to a subsequent stage driver, and an at least one subsequent stage driver supplying a data signal from a previous stage driver to a subsequent stage driver, the driver device including: a detection unit supplying a monitoring signal indicating whether a data signal is supplied to the subsequent stage driver normally to the controller; and a substitution controller supplying a substitution data signal based on a substitution control signal from the controller, wherein the controller supplies a substitution control signal making the substitution controller supply a substitution data signal when it determines that a data signal is not supplied to the subsequent stage driver normally by the monitoring signal.

13 Claims, 33 Drawing Sheets

(56) References Cited

U.S. PATENT DOCUMENTS

| | | | | |
|---|---|---|---|---|
| 2003/0142363 | A1 | 7/2003 | Oota | |
| 2007/0291021 | A1 * | 12/2007 | Awakura et al. | 345/205 |

FOREIGN PATENT DOCUMENTS

| | | |
|---|---|---|
| JP | A-2002-023713 | 1/2002 |
| JP | A-2003-295842 | 10/2003 |
| JP | A-2004-287301 | 10/2004 |
| JP | A-2005-165234 | 6/2005 |

OTHER PUBLICATIONS

International Search Report issued in International Application No. PCT/JP2009/065503 dated Nov. 24, 2009.

International Preliminary Report on Patentability issued in International Application No. PCT/JP2009/065503 dated May 10, 2011.

* cited by examiner

DISPLAY DEVICE AND DISPLAY CONTROL DEVICE

TECHNICAL FIELD

The present invention relates to a display device and a display control device.

BACKGROUND ART

There are known displays utilizing liquid crystals and organic EL. Generally, a display device is composed of a display panel, source drivers, gate drivers, a timing controller outputting a start signal to drivers, a backlight and the like. A start signal line for supplying a start signal to source drivers connects source drivers and the timing controller in series. It also connects gate drivers and the timing controller in series.

The backlight includes light emitting units, a light guiding unit that guides emitted light from the light emitting units to the display panel, and a driving driver that drives the light emitting units. The driving driver is coupled with the light emitting units via current lines. Generally, current lines are bundled in a group or groups at the input side to the driving driver, and are also bundled in a group or groups at the output side from the driving driver. As the organic EL is a natural light emitting element, the organic EL which utilizes an independent backlight module is also common.

[Patent Reference 1] Japanese Patent Application Publication No. 2003-295842

[Patent Reference 2] Japanese Patent Application Publication No. 8-204207

DISCLOSURE OF THE INVENTION

Problems to be Solved by the Invention

For example, if a failure occurs in a part of source drivers connected in series, other source drivers are not driven. Therefore, other source drivers do not function because of the failure of a part of source drivers, and a display function, which is a primary function as a display, cannot be achieved. This is the case with gate drivers.

In addition, if current lines connecting light emitting units with the driving driver are disconnected at the location where current lines are bundled together, as the current cannot be supplied to any of light emitting units, any of light emitting units are not driven. In this case, the light cannot be guided to the display panel, and the display function is not achieved because the visual contact of the display panel becomes difficult.

The present invention has been made in view of the above circumstances and aims to provide a display device and a display control device capable of maintaining a display function even when a failure occurs.

Means for Solving the Problems

The above-described aim is achieved by a display device including: a display panel capable of displaying an image; first and second drivers that drive the display panel; a timing controller that supplies a start signal controlling drives of the first and second drivers to the first and second drivers; and a start signal line that connects the timing controller and the first driver, and the timing controller and the second driver separately, and supplies the start signal from the timing controller to the first and second drivers.

As the timing controller is connected to the first driver and the second driver separately, even thought a failure occurs in one of the first and second drivers, it is possible to supply the start signal to the other. According to this, the other driver where the failure does not occur can be driven. Therefore, even though a failure occurs in a part of components, it is possible to prevent losing the display function completely, and to maintain the display function.

In addition, the above-described aim is achieved by a display device including: a display panel capable of displaying an image; first and second drivers that drive the display panel; a timing controller that supplies a start signal controlling drives of the first and second drivers to the first and second drivers; a unidirectional start signal line that connects the timing controller, the first driver and the second driver in series, and transmits the start signal from the timing controller to the first and second drivers; and a bidirectional start signal line that is connected to the unidirectional start signal line between the first driver and the second driver, is connected to the timing controller, transmits the start signal output from the timing controller to the first or second driver, and transmits a start signal output from the first or second driver to the timing controller.

According to the above display, even though a failure occurs in one of the first and second drivers, the other driver where the failure does not occur can be driven by transmitting the start line signal via the bidirectional start signal line.

In addition, the above-described aim is achieved by a display device including: a display panel capable of displaying an image; drivers that drive the display panel and are connected in series; a timing controller that controls drives of the drivers by supplying a start signal to the drivers connected in series; a selector that is located between the drivers connected in series, and supplies a start signal output from a driver located in a previous stage to a driver located in a subsequent stage; and a controller that controls the selector so that a start signal output from the timing controller is supplied to the driver located in the subsequent stage when a start signal is not output from the driver located in the previous stage.

According to the above display, it is possible to drive the driver located in the subsequent stage where the failure does not occur by controlling the selector to supply the start signal output from the timing controller to the driver located in the subsequent stage when the start signal is not output from the driver located in the previous stage.

In addition, the above-described aim is achieved by a display device that includes a group of gate lines and a group of source lines that cross each other, and displays an image by driving image pixels provided between gate lines and source lines in accordance with a source line signal at a timing of a gate line signal, a source signal to a source line being transmitted sequentially, the display device comprising: source signal abnormality detection means that detect an abnormality of the source signal; corrected source signal generation means that generate a corrected source signal to be transmitted to a subsequent stage in accordance with an abnormality location detected by the source signal abnormality detection means; and corrected source signal supply means that supply a corrected source signal generated by the corrected source signal generation means to a subsequent stage of the detected abnormality location at a timing to be transmitted.

The source line signal corresponds to a drive signal output from a drive circuit to each source line in an embodiment. The source signal corresponds to the source start signal, a source data signal, and a dot clock signal for controlling the drive signal given to the source line. This is applied to the corrected source signal.

The subsequent stage of an abnormality location is not only a stage right after the abnormality location but also may be more than two subsequent stage. Although the display region capable of displaying decreases, it is possible to increase the displayable region compared to a case where the corrected source signal is not supplied to the subsequent stage of the abnormality location.

According to the above display, as the corrected source signal to be transmitted to the subsequent stage is generated according to the detected abnormality location, and supplied to the subsequent stage of the abnormality location, the display function in the subsequent stage of the abnormality location can be maintained.

In addition, the above-described aim is achieved by a display device that includes a group of gate lines and a group of source lines that cross each other, and displays an image by driving image pixels provided between gate lines and source lines in accordance with a source line signal at a timing of a gate line signal, a gate signal to a gate line being transmitted sequentially, the display device comprising: gate signal abnormality detection means that detect an abnormality of the gate signal; corrected gate signal generation means that generate a corrected gate signal to be transmitted to a subsequent stage in accordance with an abnormality location detected by the gate signal abnormality detection means; and corrected gate signal supply means that supply a corrected gate signal generated by the corrected gate signal generation means to a subsequent stage of the detected abnormality location at a timing to be transmitted.

The gate line signal corresponds to the drive signal output from the drive circuit to each gate line in the embodiment. The gate signal corresponds to a gate start signal and a gate clock signal for controlling the drive signal given to the gate line. This is applied to the corrected gate signal.

The subsequent stage of the abnormality location is not only a stage right after the abnormality location but also may be more than two subsequent stage. Although the display region capable of displaying decreases, it is possible to increase the displayable region compared to a case where the corrected gate signal is not supplied to the subsequent stage of the abnormality location.

According to the above display, as the corrected gate signal to be transmitted to the subsequent stage is generated according to the detected abnormality location, and supplied to the subsequent stage of the abnormality location, the display function in the subsequent stage of the abnormality location can be maintained.

In addition, the above-described aim is achieved by a display control device that controls a display device including a group of gate lines and a group of source lines that cross each other, and displaying an image by driving image pixels provided between gate lines and source lines in accordance with a source line signal at a timing of a gate line signal, a source signal to a source line being transmitted sequentially, the display control device comprising; source signal abnormality detection means that detect an abnormality of the source signal; corrected source signal generation means that generate a corrected source signal to be transmitted to a subsequent stage in accordance with an abnormality location detected by the source signal abnormality detection means; and corrected source signal supply means that supply a corrected source signal generated by the corrected source signal generation means to a subsequent stage of the detected abnormality location at a timing to be transmitted.

The source line signal corresponds to the drive signal output from the drive circuit to each source line in the embodiment. The source signal corresponds to the source start signal, the source data signal, and the dot clock signal for controlling the drive signal given to the source line. This is applied to the corrected source signal.

The subsequent stage of the abnormality location is not only a stage right after the abnormality location but also may be more than two subsequent stage. Although the display region capable of displaying decreases, it is possible to increase the displayable region compared to a case where the corrected source signal is not supplied to the subsequent stage of the abnormality location.

According to the above display control device, as the corrected source signal to be transmitted to the subsequent stage is generated according to the detected abnormality location, and supplied to the subsequent stage of the abnormality location, the display function in the subsequent stage of the abnormality location can be maintained.

The above-described aim is achieved by a display control device that controls a display device including a group of gate lines and a group of source lines that cross each other, and displaying an image by driving image pixels provided between gate lines and source lines in accordance with a source line signal at a timing of a gate line signal, a gate signal to a gate line being transmitted sequentially, the display control device comprising; gate signal abnormality detection means that detect an abnormality of the gate signal; corrected gate signal generation means that generate a corrected gate signal to be transmitted to a subsequent stage in accordance with an abnormality location detected by the gate signal abnormality detection means; and corrected gate signal supply means that supply a corrected gate signal generated by the corrected gate signal generation means to a subsequent stage of the detected abnormality location at a timing to be transmitted.

The gate line signal corresponds to the drive signal output from the drive circuit to each gate line in the embodiment. The gate signal corresponds to the gate start signal and the gate clock signal for controlling the drive signal given to the gate line. This is applied to the corrected gate signal.

The subsequent stage of the abnormality location is not only a stage right after the abnormality location but also may be more than two subsequent stage. Although the display region capable of displaying decreases, it is possible to increase the displayable region compared to a case where the corrected gate signal is not supplied to the subsequent stage of the abnormality location.

According to the above display, as the corrected gate signal to be transmitted to the subsequent stage is generated according to the detected abnormality location, and supplied to the subsequent stage of the abnormality location, the display function at the subsequent stage of the abnormality location can be maintained.

In addition, the above-described aim is achieved by a display device that includes a liquid crystal unit and a backlight unit composed of light sources lighting the liquid crystal unit, the display device comprising: display defective region detection means that detect a display defective region of the liquid crystal unit; and lights-out control means that turn off light sources of the backlight unit corresponding to a display defective region detected by the display defective region detection means.

Therefore, light sources in an undisplayable region can be turned off.

In addition, the above-described aim is achieved by a display device including: a display panel capable of displaying an image; light source materials; a light guide plate that guides light sources from the light source materials to the display panel; and a driving driver that is wiring-connected to the light source materials and supplies a current, wherein the light source materials are divided into groups connected by a same wiring, and neighboring light source materials do not belong to a same group.

Therefore, as neighboring light sources are not connected each other by the same wiring, all of light sources are not turned off even though the disconnection and the like occur.

In addition, the above-described aim is achieved by a display device including: a display panel capable of displaying an image; light source materials; a light guide plate that guides light sources from the light source materials to the display panel; and a driving driver that is wiring-connected to the light source materials and supplies a current, wherein the light source materials are divided into groups connected by a same wiring, and a given number of neighboring light source materials belongs to a same group.

Therefore, when the disconnection and the like occur, a part of light sources are turned off, and other light sources can keep lighting.

Effects of the Invention

According to the present invention, it is possible to provide a display device capable of maintaining a display function even when a failure occurs.

EMBODIMENT FOR CARRYING OUT THE INVENTION

A description will now be given, with reference to the accompanying drawings, of exemplary embodiments of the present invention.

First Embodiment

Figure 1:
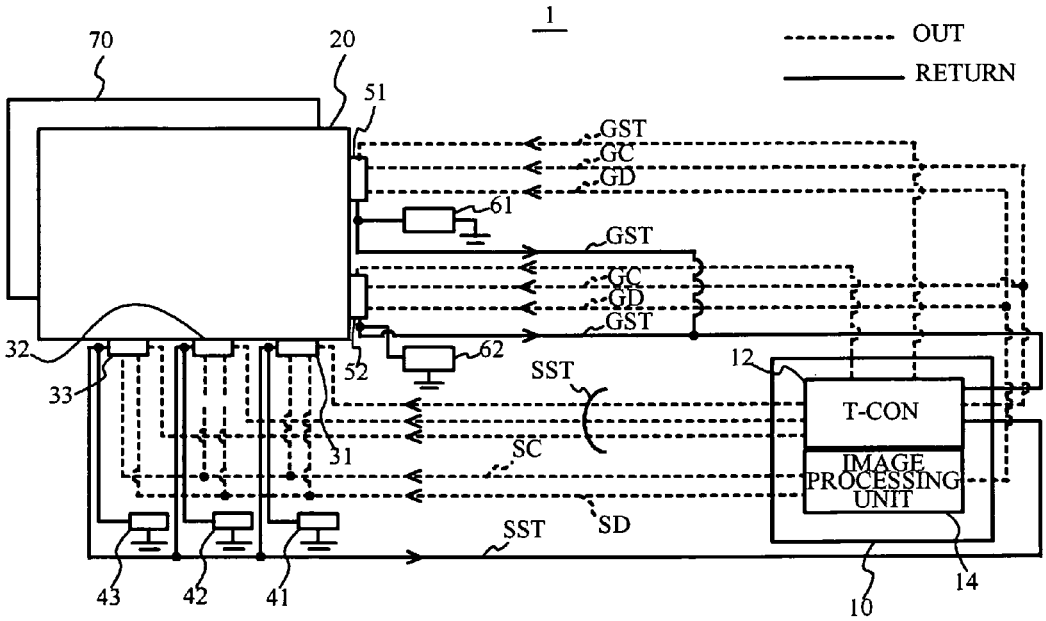
FIG. 1 is a configuration diagram of a display device in accordance with a first embodiment.

FIG. 1 is a configuration diagram of a display device in accordance with a first embodiment. A display device 1 in accordance with the first embodiment includes a controller 10, a display panel 20, source drivers 31 through 33, monitoring elements 41 through 43, gate drivers 51 and 52, monitoring elements 61 and 62, and a light guide plate 70.

The controller 10 controls the behavior of the display device 1, and includes a timing controller 12 and an image processing unit 14. The controller 10 is composed of a CPU (Central Processing Unit), a RAM (Random Access Memory), a ROM (Read Only Memory) and the like, and functions of the timing controller 12 and the image processing unit 14 are achieved by these hardware. The hardware of the controller 10 is not limited to a CPU, a ROM, or a RAM, and a logic circuit and a storage device may be used.

The display panel 20 is able to display images in response to various signals supplied from the controller 10. A detail is not illustrated, but the display panel 20 includes a substrate where a pixel pattern is formed. This substrate includes a number of gate lines and data lines crossing each other. Pixels are formed at intersection points of gate lines and data lines, and the image display operation of pixels is controlled by a thin-film transistor which is a kind of switching element.

Each of source drivers 31 through 33 is coupled with the controller 10 by data lines. In the same manner, each of gate drivers 51 and 52 is coupled with the controller 10 by data lines.

Gate drivers 51 and 52 select each data line on the display panel 20 sequentially in one horizontal scan period. The thin film transistor of the pixel connected to the selected gate line changes the state of the corresponding pixel to the displayable state.

Source drivers 31 through 33 receive inputs of source data corresponding to image data provided from the image processing unit 14, and apply predetermined gamma voltages to corresponding data lines to display image information to pixels connected to the selected gate line.

The timing controller 12 generates signals for controlling the drive of source drivers 31 through 33 and gate drivers 51 and 52 such as a source start signal (SST), a gate start signal (GST), a source clock signal (SC), a gate clock signal (GCL), a source data signal (SD) and a gate data signal (GD). The source start signal (SST) is a signal that notifies source drivers 31 through 33 of an operation start timing. In addition, the source start signal (SST) is also used for detecting the failure in each of source drivers 31 through 33. In the same manner, the gate start signal is a signal that notifies gate drivers 51 and 52 of an operation start timing. In addition, the gate start signal (GST) is used for detecting the failure in each of gate drivers 51 and 52. The clock signal is a signal that defines the operation timing of each driver.

As illustrated in FIG. 1, start signal lines for supplying the source start signal (SST) from the timing controller 12 to source drivers 31 through 33 connect the timing controller 12 and source drivers 31 through 33 in parallel. In FIG. 1, signal lines output from the controller 10 are illustrated with a dashed line, and signal lines going back to the controller 10 are illustrated with a solid line.

Monitoring elements 41 through 43 are described later.

The light guide plate 70 guides lights from LEDs (Light Emitting Diode) not shown to the display panel 20. The light guide plate 70, LEDs and the like compose so-called backlight of the display panel 20.

Figure 2:
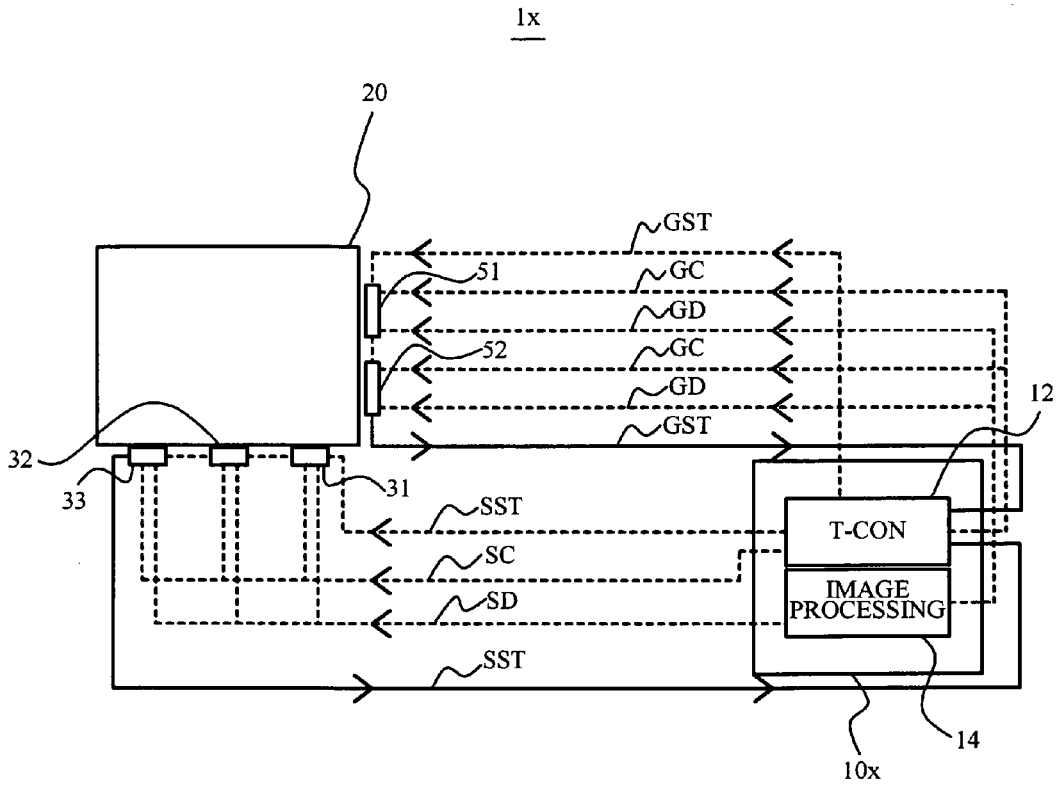
FIG. 2 is a configuration diagram of a display device having a different configuration from the display device in accordance with the first embodiment.

Here, the display device 1 is compared with a display device 1*x* having a different configuration from the display device 1. FIG. 2 is a configuration diagram of the display device 1*x* having a different configuration from the display device 1. Same or similar reference numerals are put to identical or similar configurations to the display device 1 in the display device 1*x*.

As illustrated in FIG. 2, in the display device 1*x*, a start signal line for supplying the source start signal (SST) from the timing controller 12 to source drivers 31 through 33 connects the timing controller 12 and source drivers 31 through 33 in series. Thus, in the display device 1*x*, the source start signal (SST) output from the timing controller 12 is supplied to the source driver 31 firstly, then transmitted to source drivers 32 and 33 sequentially, and transmitted to the timing controller 12 again. In the display device 1*x*, if a failure occurs in the source driver 31 for example, the source start signal (SST) supplied to the source driver 31 is not transmitted to the source driver 32. In addition, as the source start signal (SST) is not supplied to the source driver 32, the source start signal (SST) is not supplied to the source driver 33 either. Therefore, when a failure occurs in the source driver 31, source drivers 32 and 33 are not driven. When source drivers 31 through 33 are not driven, an image is not displayed on the display panel 20 normally.

However, in the display device 1, as illustrated in FIG. 1, start signal lines connect the timing controller 12 and source drivers 31 through 33 in parallel. Accordingly, even though a failure occurs in the source driver 31 for example, it is possible to supply the source start signal (SST) to source drivers 32 and 33. In this case, it is not possible to display the image in regions on the display panel 20 corresponding to data lines connected to the source driver 31. However, it is possible to display the image in regions corresponding to data lines connected to source drivers 32 and 33.

As described above, when a failure occurs in a part of source drivers, it is not possible to display an image in a partial region, but it is possible to display the image in regions other than the partial region. Thus, it is possible to maintain a display function even when a failure occurs in a part of source drivers.

For example, when the display device 1 is mounted to a vehicle, and the display device 1 is used for displaying a speed of the vehicle, it is possible to display a part of an original image even in a case where a failure occurs in a part of source drivers. This secures the safety of driving.

A description will now be given of monitoring elements 41 through 43. Monitoring elements 41 through 43 detect voltage values or current values of source start signals (SST) output from source drivers 31 through 33 respectively. Detection results of monitoring elements 41 through 43 are transmitted to the controller 10 via signal lines not illustrated. The controller 10 determines whether or not a failure occurs in source drivers 31 through 33 based on detection signals transmitted from monitoring elements 41 through 43. The controller 10 corresponds to a driver failure detection unit. For example, if a failure occurs in the source driver 31, the monitoring element 41 cannot detect a voltage value or current value of the source start signal (SST) output from the source driver 31. Therefore, the controller 10 does not receive the detection signal from the monitoring element 41 when a predetermined timing comes. This enables the controller 10 to determine that a failure occurs in the source driver 31.

Monitoring elements 61 and 62 that monitor the failure of gate drivers 51 and 5 detect voltage values or current values of gate start signals (GST) output from gate drivers 51 and 52 respectively. Detection results of monitoring elements 61 and 62 are transmitted to the controller 10 via signal lines not shown.

The controller 10 determines the region where the image can be displayed on the display panel 20 based on the determination result of failure, reduces the image according to the size of the displayable region, and displays the image. The reduction process of the image is executed by the image processing unit 14 of the controller 10.

Figure 3:
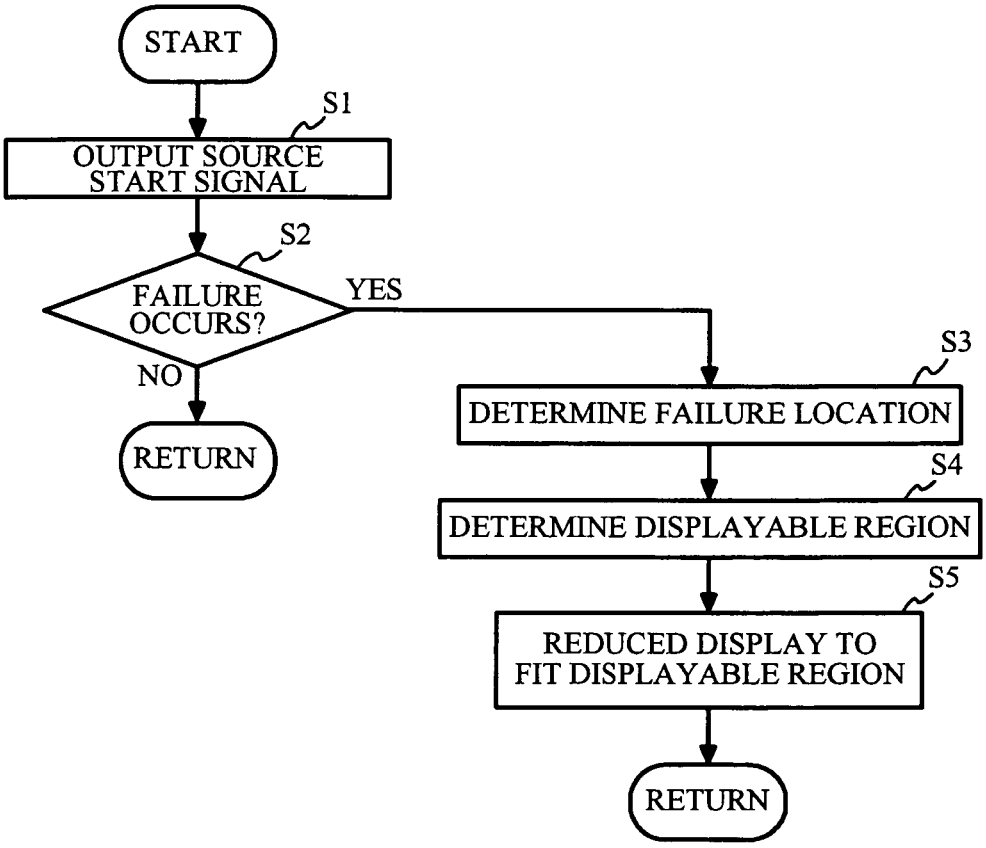
FIG. 3 is a flowchart illustrating a reduced display process executed by a controller.

A description will now be given of a reduced display process executed by the controller 10. FIG. 3 is a flowchart illustrating a reduced display process executed by the controller 10.

The controller 10 outputs the source start signal (SST) to source drivers 31 through 33 (step S1), and the controller 10 determines whether a failure occurs in at least one of source drivers 31 through 33 based on detection signals from monitoring elements 41 through 43 (step S2). When a failure does not occur, the controller 10 executes a routine process. When the failure is detected, the controller 10 determines in which of source drivers 31 through 33 the failure occurs (step S3), and determines a displayable region on the display panel 20 (step S4). The displayable region is a region corresponding to data lines connected to source drivers in which the failure is not detected. Then, the controller 10 reduces the image to be displayed in the whole region of the display panel 20 under normal circumstances according to the displayable region, and displays it in the displayable region (step S5).

Figure 4:
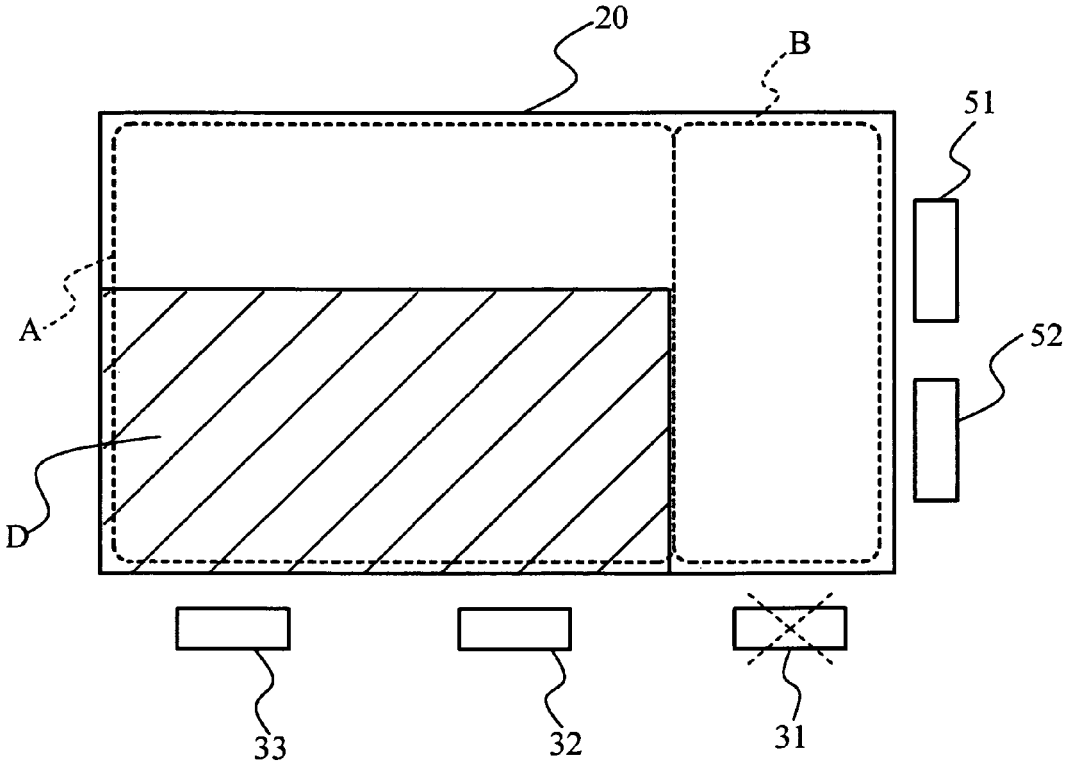
FIG. 4 is an explanatory diagram of a case executing a reduced display on a display panel.

A description will now be given of examples of a reduced display. FIG. 4 is an explanatory diagram of a reduced display on the display panel 20. For example, if a failure occurs in the source driver 31, as illustrated in FIG. 4, the displayable region A is a region corresponding to data lines connected to source drivers 32 and 33. In addition, the undisplayable region B is a region corresponding to data lines connected to the source driver 31. The controller 10 compresses the image, which is to be displayed in the whole region of the display panel 20 under normal circumstances, and displays the compressed image in the displayable region A as a display image D. According to this, the size of the image is reduced, but the user can see the presented contents.

If a failure occurs only in the source driver 32, the center region on the display panel 20 becomes the undisplayable region, and the displayable region is divided into two. In this case, the controller 10 displays the reduced image of the original image in one of two displayable regions. Alternatively, the original image may be reduced so as to fit the size of two displayable regions, the reduced image may be divided into two, and divided reduced images may be displayed in divided displayable regions.

When a failure occurs in only the source driver 33, the displayable region becomes a region corresponding to data lines connected to source drivers 31 and 32, and the reduced image which fits to the size of the displayable region is displayed.

When the controller 10 detects the failure of one of source drivers 31 through 33, it may display a warning image for warning the user about the detection of failure on the display panel 20. When an alarm unit such as a speaker is provided, the controller 10 may output the voice reporting the detection of failure from the alarm unit, and notify the user of the detection of failure.

In addition, gate drivers 51 and 52 and the timing controller 12 may be connected in parallel. In this case, even though a failure occurs in one of gate drivers 51 and 52, the other one can be driven.

Figure 5:
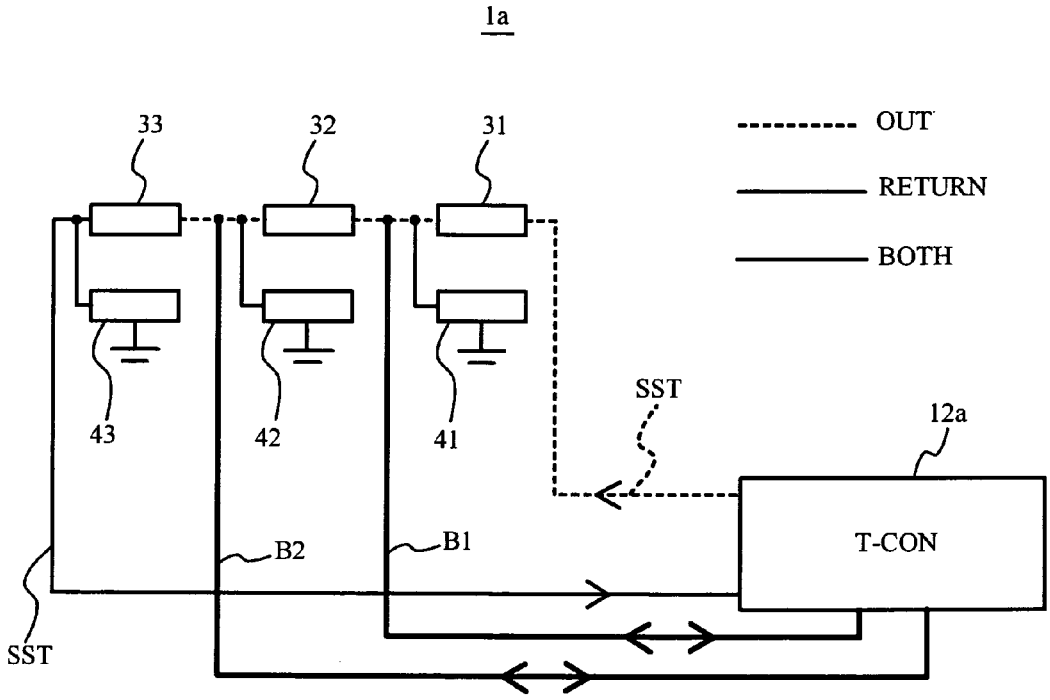
FIG. 5 is a configuration diagram of a display device in accordance with a first variant embodiment.

A description will now be given of a display device 1*a* in accordance with a first variant embodiment. FIG. 5 is a configuration diagram of the display device 1*a*. A description of the same configuration as the display device 1 described above is omitted by putting same reference numerals. In FIG. 5, some components are omitted.

As illustrated in FIG. 5, in the display device 1*a*, the start signal line connects a timing controller 12*a* and source drivers 31 through 33 in series. This start signal line can transmit the source start signal (SST) to only one direction. In the description about the display device 1*a*, this start signal line is referred to as a series start signal line.

In addition, a bidirectional start signal line B1 is connected to the series start signal line located between the source driver 31 and the source driver 32. A bidirectional start signal line B2 is connected to the series start signal line located between the source driver 32 and the source driver 33. The bidirectional start signal lines B1 and B2 can transmit the source start signal (SST) bidirectionally by the control by the timing controller 12*a*.

When a failure does not occur in any of source drivers 31 through 33, the source start signal (SST) is transmitted from the timing controller 12*a* to source drivers 31 through 33 sequentially via the series start signal line. When the failure does not occur in any of source drivers 31 through 33, the source start signal (SST) is also transmitted to the timing controller 12*a* by the bidirectional start signal lines B1 and B2. When the timing controller 12*a* does not receive the source start signal (SST) from the bidirectional start signal line B1 or B2 although the predetermined timing comes, it determines the failure of source drivers 31 through 33.

When the timing controller 12*a* detects the failure in one of source drivers 31 through 33, it switches the transmission path from the above case. For example, when the failure of the source driver 31 is detected, the timing controller 12*a* transmits the source start signal (SST) to the source drivers 32 with the bidirectional start signal line B1. The source start signal (SST) transmitted to the source driver 32 is transmitted to the source driver 33. The source start signal (SST) transmitted to the source driver 33 goes back to the timing controller 12*a* again via the series start signal line. When the timing controller 12*a* detects the failure in one of source drivers 31 through 33, it stops the operation of the source driver 31, 32 or 33 where the error is detected. That is to say, the power source of the source driver 31, 32 or 33 where the failure is detected is turned off, and the output state of the source start signal (SST) from the source driver 31, 32 or 33 where the failure occurs is set to high impedance. It is possible to use methods other than power-off if the objective of methods is to set high impedance.

If the failure of the source driver 32 is detected, the timing controller 12*a* transmits the source start signal (SST) from the timing controller 12*a* to the source driver 31 via the series start signal line. The source start signal (SST) transmitted to the source driver 31 is returned to the timing controller 12*a* from the source driver 31 via the bidirectional start signal line B1. In addition, the timing controller 12*a* transmits the source start signal (SST) from the timing controller 12 to the source driver 33 via the bidirectional start signal line B2. The source start signal (SST) transmitted to the source driver 33 is returned to the timing controller 12*a* via the series start signal line.

When the failure of the source driver 33 is detected, the timing controller 12*a* transmits the source start signal (SST) from the timing controller 12*a* to the source driver 31 via the series start signal line, the source start signal (SST) transmitted to the source driver 31 is transmitted to the source driver 32 via the series start signal line, and the source start signal (SST) transmitted to the source driver 32 is returned to the timing controller 12*a* via the bidirectional start signal line B2.

As described above, the timing controller 12*a* switches the path of the source start signal (SST) in response to the location where the failure occurs. According to this, even when a failure occurs in a part of source drivers, it is possible to supply the source start signal (SST) to other source drivers.

The bidirectional start signal line may be connected to the start signal line located between gate drivers 51 and 52.

Figure 6:
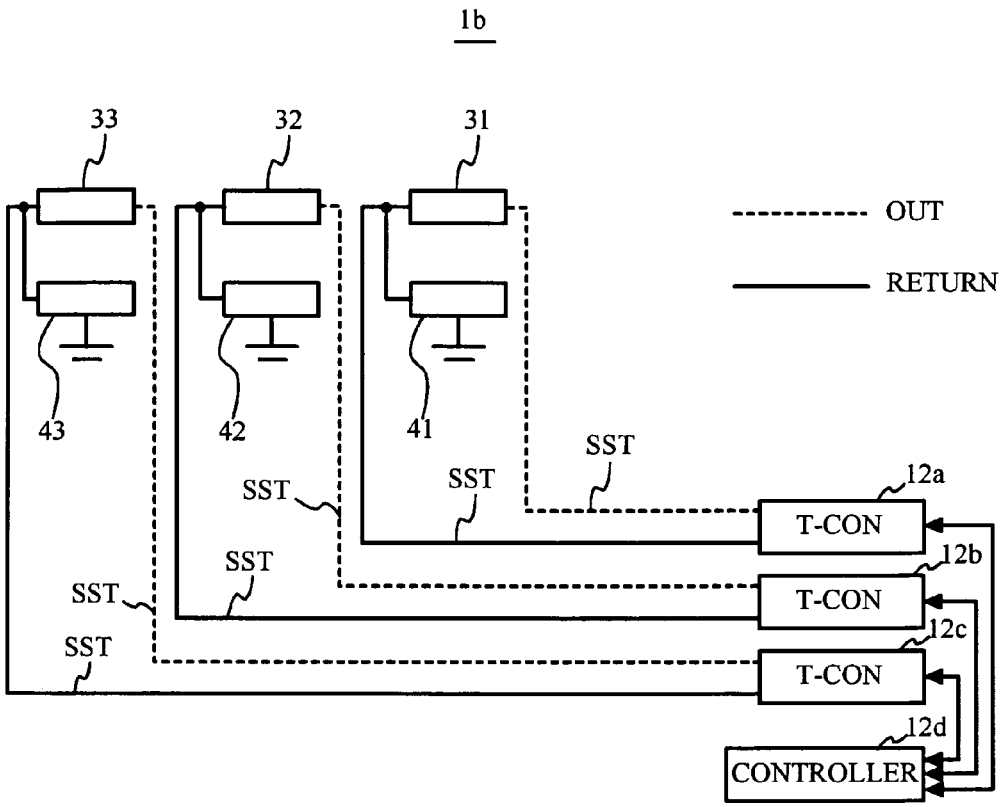
FIG. 6 is a configuration diagram of a display device in accordance with a second variant embodiment.

A description will now be given of a display device 1*b* in accordance with a second variant embodiment. FIG. 6 is a configuration diagram of the display device 1*b* in accordance with the second variant embodiment.

As illustrated in FIG. 6, timing controllers 12*a* through 12*c* are connected to source drivers 31 through 33 respectively. A controller 12*d* for controlling the timing of when each of timing controllers 12*a* through 12*c* outputs the source start signal (SST) is provided. According to this, source start signals (SST) to source drivers 31 through 33 are supplied by timing controllers 12*a* through 12*c* which are independent of each other. Thus, even when a failure occurs in a part of source drivers 31 through 33, it is possible to drive other source drivers. In addition, even when a failure occurs in one of timing controllers 12*a* through 12*c*, as timing controllers where the failure does not occur operate as normal, the effect caused by the failure of the timing controller is minimized.

Second Embodiment

Figure 7:
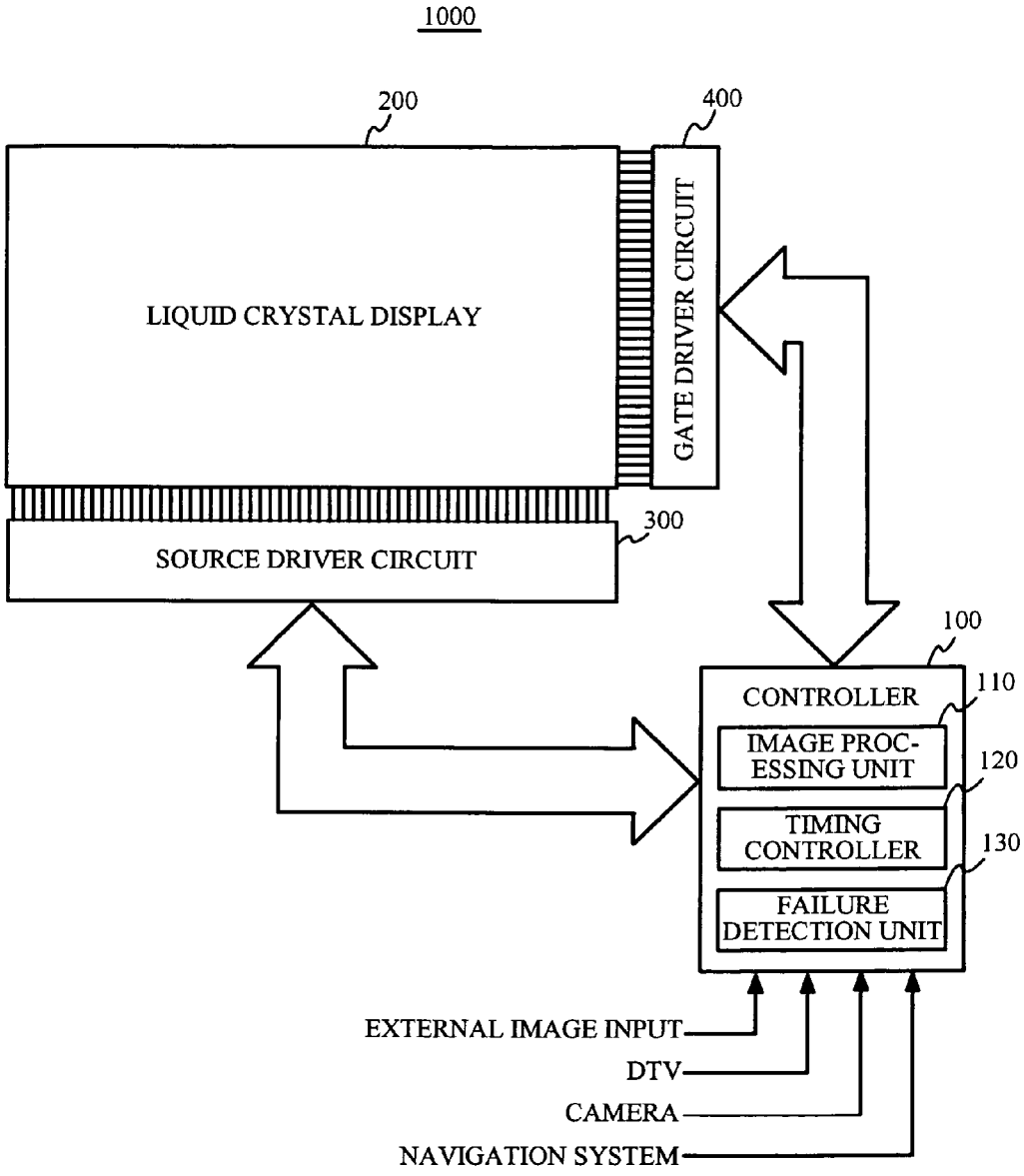
FIG. 7 is a configuration diagram of a display device in accordance with a second embodiment.

A description will now be given of a display device in accordance with a second embodiment with reference to FIG. 7. A display device 1000 (corresponding to a display device of the present invention) in accordance with the second embodiment is provided with a controller 100 (corresponding to a display control device) that controls a display, a liquid crystal display 200 that displays information, a source driver circuit 300 that selectively drives source lines according to the control by the controller 100, and a gate driver circuit 400 that selectively drives gate lines according to the control by the controller 100. Hereinafter, a detail description will be given of each configuration.

Figure 8:
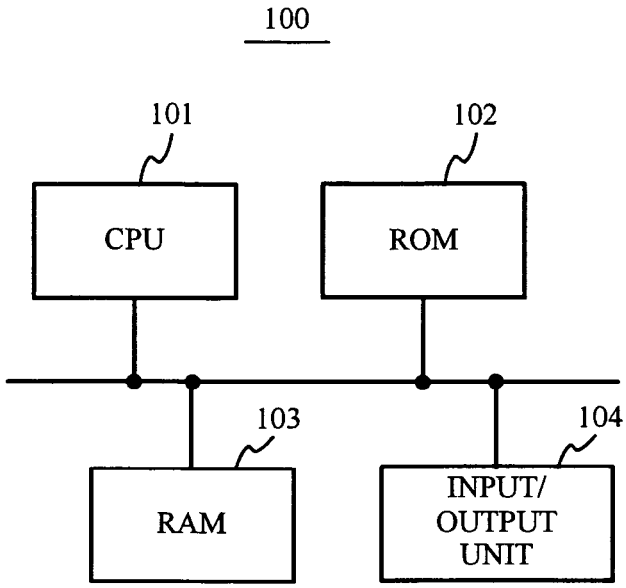
FIG. 8 is a diagram illustrating a hardware structure of the controller.

The controller 100 controls the behavior of the display device 1000, and includes a CPU (Central Processing Unit) 101, a ROM (Read Only Memory) 102, a RAM (Random Access Memory) 103, an input/output unit 104 and the like illustrated in FIG. 8 as hardware. Control programs are stored in the ROM 102, and the cooperation of the control programs and the hardware resources such as the CPU 101, the ROM 102, and the RAM 103 achieves functional blocks of the controller 100 illustrated in FIG. 7. The controller 100 includes an image processing unit 110, a timing controller 120 and a failure detection unit 130 illustrated in FIG. 7 as functional blocks. Data during the calculation or data after the calculation by the CPU 101 is stored in the RAM 102. The input/output unit 104 receives video data and image data output from a DTV (digital television), a camera, a navigation device, and video data and image data input from the external image input terminal, and outputs them to the CPU 101. In addition, the input/output unit 104 outputs the control signal generated in the CPU 101 to the source driver circuit 300 and the gate driver circuit 400 via the input/output unit 104.

The hardware of the controller 100 is not limited to the CPU, the ROM, and the RAM, and it is possible to use a logic circuit and a storage device.

The image processing unit 110 executes image processing such as an image size adjustment of the image data to be displayed on the liquid crystal display 200, and the image quality (contrast, brightness, color tone, gamma value). The image processing unit 110 corresponds to corrected source signal supply means of the present invention.

The timing controller 120 controls a display timing and a display position for displaying the image data, to which the image quality adjustment and the size adjustment are carried out by the image processing unit 110, on the liquid crystal display 200. The timing controller 120 controls the display timing and the display position by controlling the source driver circuit 300 and the gate driver circuit 400. The timing controller 120 corresponds to corrected source signal generation means, corrected gate signal generation means, corrected source signal supply means, and corrected gate signal supply means of the present invention.

The failure detection unit 130 monitors operations of the source driver circuit 300 and the gate driver circuit 400, and if it detects a failure location in these circuits, it notifies the image processing unit 110 and the timing controller 120 of the detected failure location. The image processing unit 110 and the timing controller 120 that receive the failure notification from the failure detection unit 130 control signals output to the source driver circuit 300 and the gate driver circuit 400, and display information in a display region other than the failure region detected by the failure detection unit 130. The failure detection unit 130 corresponds to source signal abnormality detection means and gate signal abnormality detection means of the present invention.

Figure 9:
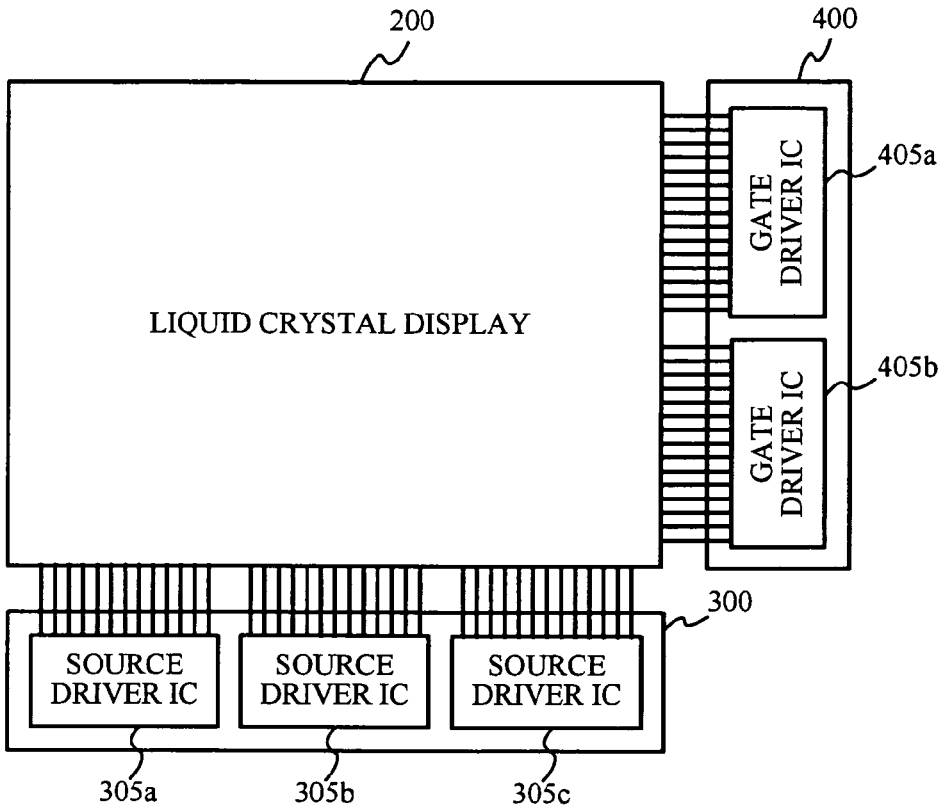
FIG. 9 is a diagram illustrating configurations of a source driver circuit and a gate driver circuit.

A description will now be given of the source driver circuit 300 and the gate driver circuit 400 with reference to FIG. 9. Source driver ICs 305*a*, 305*b*, 305*c*, . . . , 305*n* (n is an arbitrary natural number) are located inside the source driver circuit 300. In the same manner, gate driver ICs 405*a*, 405*b*, . . . , 400*m* (m is an arbitrary natural number) are located inside the gate driver circuit 400. In FIG. 9, the source driver circuit 300 provided with three source driver ICs 305*a*, 305*b* and 305*c* is illustrated as an example. In the same manner, in FIG. 9, the gate driver circuit 400 provided with two gate drivers IC 405*a* and 405*b* is illustrated as an example. As source driver ICs 305*a*, 305*b* and 305*c* have almost identical configuration, they are referred to as source driver IC(s) 305 when it is not necessary to distinguish source driver ICs 305*a*, 305*b* and 305*c* from each other. In the same manner, gate driver ICs 405*a* and 405*b* have almost identical configuration, they are referred to as gate driver IC(s) 405 when it is not necessary to distinguish gate driver ICs 405*a* and 405*b* from each other.

Figure 10:
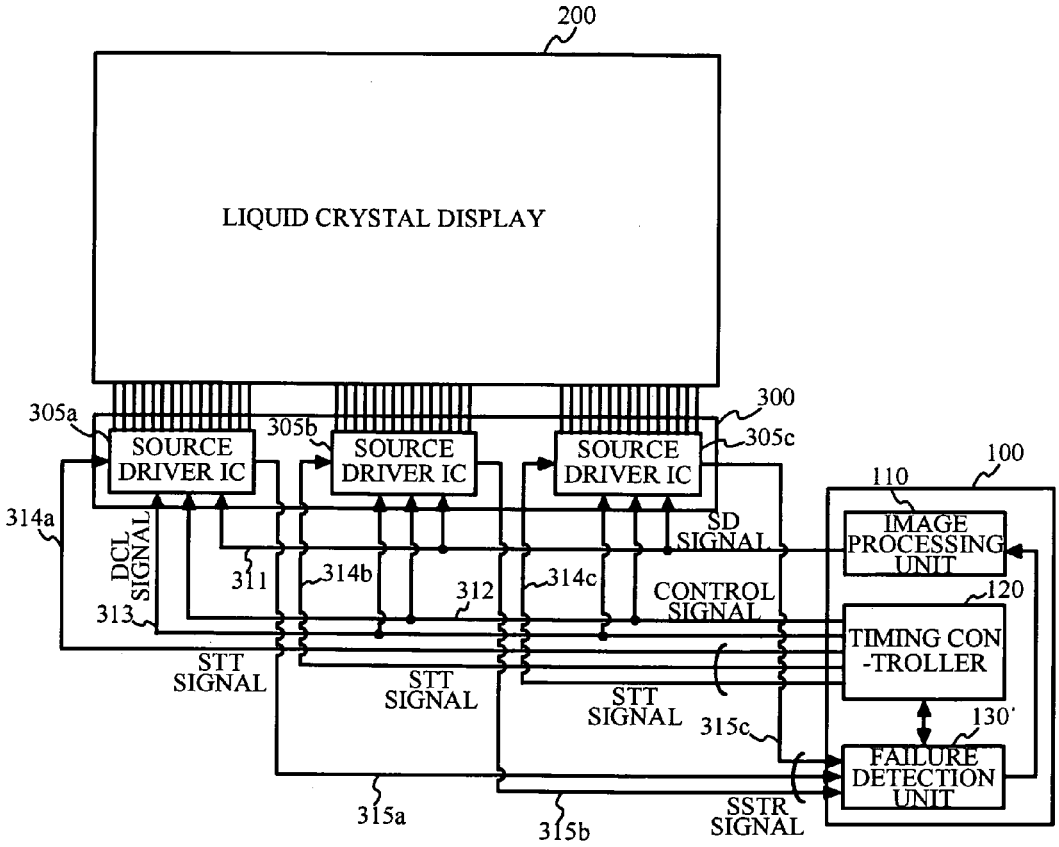
FIG. 10 is a diagram illustrating a connection wiring between the source driver circuit and the controller.

A description will now be given of a signal wiring connecting the controller 100 and each of source driver ICs 305*a*, 305*b* and 305*c* with reference to FIG. 10.

Each of source driver ICs 305*a*, 305*b* and 305*c* is connected to the image processing unit 110 by a data line 311. One end of the data line 311 is coupled to the image processing unit 110, and another end is divided into three in the middle, and is coupled to source driver ICs 305*a*, 305*b* and 305*c*. The image processing unit 110 and source driver ICs 305*a*, 305*b* and 305*c* may be connected in parallel by three data lines. Signals for displaying the image to which the image processing is executed by the image processing unit 110 (hereinafter, there is a case to be abbreviated as a source data signal (SD)) are transmitted from the image processing unit 110 to source driver IC 305*a*, 305*b* and 305*c*.

In addition, each of source driver ICs 305*a*, 305*b* and 305*c* is connected to the timing controller 120 by three control lines 312, 313 and 314. One ends of control lines 312 and 313 are connected to the timing controller 120, and other ends are divided into three, and connected to source driver ICs 305*a*, 305*b* and 305*c*. The control line 314 connects the timing controller 120 and source driver ICs 305*a*, 305*b* and 305*c* in parallel by three control lines 314*a*, 314*b* and 314*c* respectively.

Control signals are transmitted from the timing controller 120 to source driver ICs 305*a*, 305*b* and 305*c* via the control line 312. Control signals are signals that control a timing of when source driver IC 305*a*, 305*b* and 305*c* output drive signals for TFT (Thin Film Transistor) elements to respective source lines.

A dot clock signal (there is a case to be abbreviated as DCL) is transmitted from the timing controller 120 to source driver IC 305*a*, 305*b* and 305*c* via the control line 313. The dot clock signal (DCL) is a signal defining the operation timing of the source driver IC 305.

In addition, a source start signal (there is a case to be abbreviated as SST) is transmitted from the timing controller 120 to source driver ICs 305*a*, 305*b* and 305*c* via control lines 314*a*, 314*b* and 314*c* respectively. The source start signal (SST) is a signal to notify source driver ICs 305*a*, 305*b* and 305*c* of an operation start timing. In addition, the source start signal (SST) is also a signal for detecting a failure in source driver IC IC305*a*, 305*b* and 305*c*.

The failure detection unit 130 is connected to source driver ICs 305*a*, 305*b* and 305*c* by data lines 315*a*, 315*b* and 315*c* respectively. Source driver ICs 305*a*, 305*b* and 305*c* start the operation by receiving the source start signal (SST), and when the operation in each of source driver ICs 305*a*, 305*b* and 305*c* is completed, a source start return signal (hereinafter, there is a case to be abbreviated as SSTR) that notifies of the normal end of the operation is output to the failure detection unit 130.

The failure detection unit 130 receives information about the source driver IC 305 to which the timing controller 120 transmitted the source start signal (SST) and about an output timing of the source start signal (SST) from the timing controller 120. When the failure detection unit 130 does not receive the source start return signal (SSTR) from the source driver IC 305 to which the timing controller 120 transmitted the source start signal (SST) even though a predetermined time passes after the source start signal (SST) was transmitted, or when an abnormality occurs in a timing of receiving the source start return signal (SSTR) by the failure detection unit 130, it determines that a failure occurs in the source driver IC 305 to which the source start signal (SST) was transmitted. To prevent a misdetection, it is preferable to have redundancy in the determination, and for example, the abnormality is determined when an abnormal state is detected several successive times (this is applied to a determination process described hereinafter).

When the failure detection unit 130 detects the failure in the source driver IC 305, it notifies the timing controller 120 and the image processing unit 110 of the source IC 305 where the failure is detected. The timing controller 120 which receives the notification does not output the source start signal (SST) to the source driver IC 305 where the failure occurs. For example, when the failure is detected in the source driver IC 305*a*, the source start signal (SST) is output to the source driver IC 305*b* and the source driver IC 305*c*.

Figure 11:
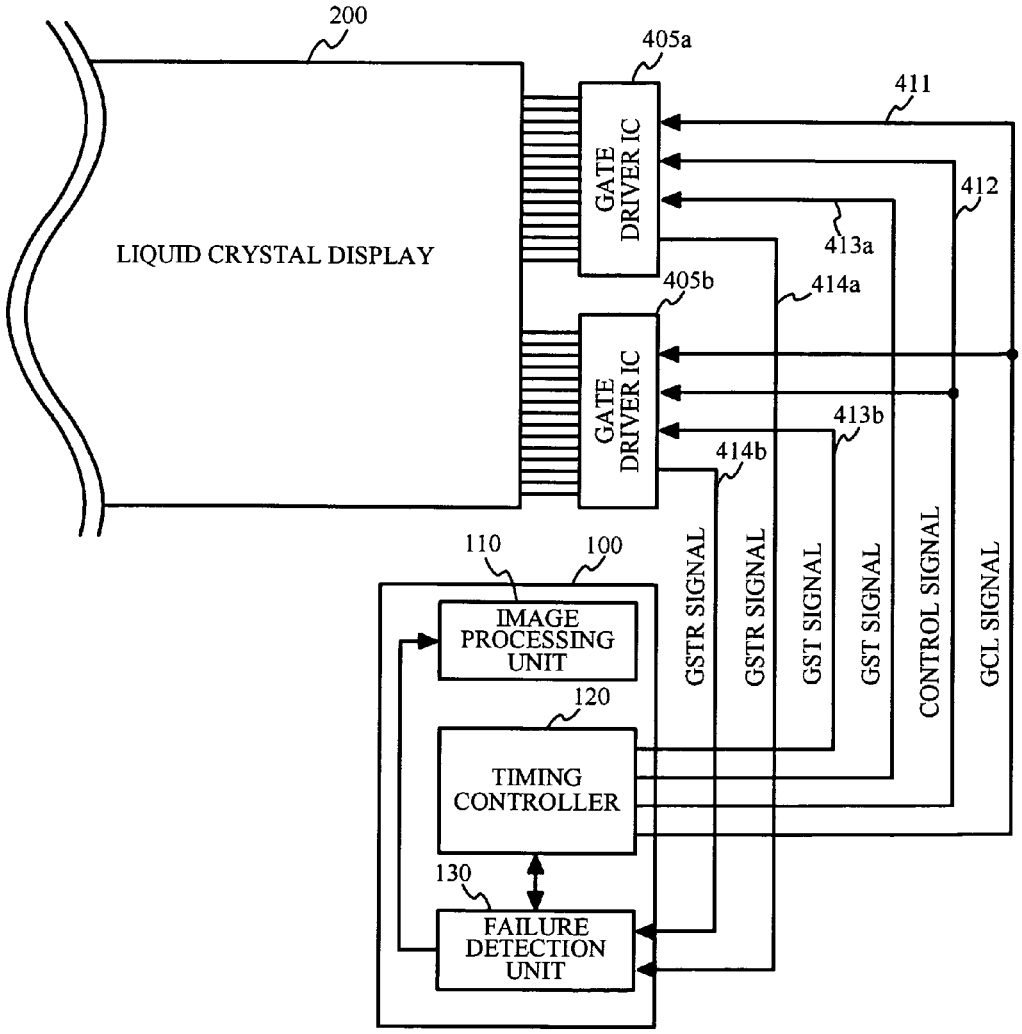
FIG. 11 is a diagram illustrating a connection wiring between the gate driver circuit and the controller.

A description will now be given of a signal wiring that connects the controller 100 and each of gate driver ICs 405*a* and 405*b* with reference to FIG. 11.

Each of gate driver ICs 405*a* and 405*b* is connected to the timing controller 120 by three control lines 411, 412 and 413. One ends of control lines 411 and 412 are connected to the timing controller 120, and other ends are divided into two, and connected to gate driver ICs 405*a* and 405*b*. The control line 413 includes a control line 413*a* and a control line 413*b*, and connects the timing controller 120 and gate driver ICs 405*a* and 405*b* in parallel.

A gate clock signal (hereinafter, there is a case to be abbreviated as GCL) is transmitted from the timing controller 120 to gate driver ICs 405*a* and 405*b* via the control line 411. The gate clock signal (GCL) is a signal defining an operation timing of gate driver ICs 405*a* and 405*b*.

Control signals are transmitted from the timing controller 120 to gate driver ICs 405*a* and 405*b* via the control line 412. Control signals are signals for controlling a timing of outputting a drive signal for driving TFT elements from gate driver ICs 405*a* and 405*b* to respective gate lines.

A gate start signal (there is a case to be abbreviated as GST signal) is transmitted from the timing controller 120 to gate driver ICs 405*a* and 405*b* via control lines 413*a* and 413*b*. The gate start signal (GST) is a signal for notifying gate driver ICs 405*a* and 405*b* of the start of operation. The gate start signal (GST) is a signal for detecting a failure in each of gate driver ICs 405*a* and 405*b*.

The failure detection unit 130 is connected to gate driver ICs 405*a* and 405*b* by control lines 414*a* and 414*b* respectively. Gate driver ICs 405*a* and 405*b* start the operation by receiving the gate start signal (GST), and when the operation in each of gate driver ICs 405*a* and 405*b* is completed, a gate start return signal (hereinafter, there is a case to be abbreviated as GSTR) for notifying of the normal end of the operation is output to the failure detection unit 130.

In the same manner as the case of the source driver IC 305, the failure detection unit 130 receives information about the gate driver IC 405 to which the timing controller 120 transmitted the gate start signal (GST) and about the output timing of the gate start signal (GST) from the timing controller 120. When the failure detection unit 130 does not receive the gate start return signal (GSTR) from the gate driver IC 405 to which the timing controller 120 transmitted the gate start signal (GST) even though a predetermined time passes after the transmission of the gate start signal (GST), it determines that the failure occurs in the gate driver IC 405.

When the failure detection unit 130 detects the failure in the gate driver IC 405, it notifies the timing controller 120 and the image processing unit 110 of the gate driver IC 405 where the failure is detected. The timing controller 120 that receives the notification does not output the gate start signal (GST) to the gate driver IC 405 where the failure occurs. The gate start signal (GST) is output to the gate driver IC 405 where the failure does not occur at the normal timing.

A description will now be given of a configuration of the source driver IC 305 with reference to FIG. 12.

The source driver IC 305 is provided with drive circuits 320*a* through 320*k* (k is an arbitrary natural number). Each of drive circuits 320*a* through 320*k* is provided with a digital circuit 321, an AND (logical product) circuit 322, a hold circuit 323, and a buffer circuit 324. To distinguish which circuits are included in which of drive circuits 320*a* through 320*k*, each circuit is indicated with a same alphabet as the drive circuit. For example, circuits included in the drive circuit 320*a* are described as a digital circuit 321*a*, an AND circuit 322*a*, a hold circuit 323*a*, and a buffer circuit 324*a*. In addition, in the following description, as digital circuits 321*a* through 321*k* have almost identical configuration, they are simply described as the digital circuit 321 when it is not necessary to distinguish the digital circuit 321*a* through 321*k* from each other. This is applied to AND circuits 322*a* through 322*k*, hold circuits 323*a* through 323*k*, and buffer circuits 324*a* through 324*k*.

Drive circuits 320*a* through 320*k* are provided so as to correspond to respective source lines of the liquid crystal display 200. One of the digital circuit 321*a* through 321*k*, one of AND circuits 322*a* through 322*k*, one of hold circuit 323*a* through 323*k*, and one of buffer circuits 324*a* through 324*k* are provided with respect to one source line.

The digital circuit 321 receives the dot clock signal (DCL) and the source start signal (SST). A first power source for operating the digital circuit 321 is supplied to each digital circuit 321. The digital circuit 321 works as a flip-flop. In other words, the digital circuit 321 holds the signal level (high level or low level) of the source start signal (SST) in synchronization with the rising timing of the dot clock signal (DCL). A signal in accordance with the held signal level of the source start signal (SST) is output from the digital circuit 321 to the AND circuit 322 and the digital circuit 321 located in the subsequent stage. The digital circuit 321 located in the subsequent stage imports and holds the signal level (high level or low level) of the output signal from the digital circuit 321 located in the previous stage in synchronization with the next rising timing of the dot clock signal (DCL). This operation is repeated, and the signal is transmitted from the digital circuit 321*k* located in the final stage to the failure detection unit 130 as a source start return signal (SSTR).

The failure detection unit 130 monitors whether or not the source driver IC 305 that receives the source start signal (SST) transmitted from the timing controller 120 completes the operation normally and outputs the source start return signal (SSTR). When the failure detection unit 130 cannot detect the source start return signal (SSTR), it determines that the failure occurs in the source driver IC 305 to which the source start signal (SST) was transmitted. That is to say, it is possible to determine whether the disconnection occurs in the control line 314 which supplies the source start signal (SST) to source driver ICs 305*a* through IC305*c*, whether the disconnection occurs in the wiring connecting digital circuits 321 each other, and whether the first power source is supplied to each of digital circuits 321*a* through 321*k*, and digital circuits 321*a* through 321*k* operates normally.

A same process is executed for gate driver ICs 405*a* and 405*b*.

The AND circuit 322 receives the source data signal (SD) and the output signal of the digital circuit 321. In addition, the output side of the AND circuit 322 is connected to the hold circuit 323. The AND circuit 322 outputs the received source data signal (SD) to the hold circuit 323 in a case where the output signal of the digital circuit 321 is at high level. The AND circuit 322 not only works as a gate outputting the signal with high level or low level, but also transmits the signal in accordance with the voltage of the input signal (source data signal (SD)) of the AND circuit 322 to the hold circuit 323.

The hold circuit 323 receives an output signal from the AND circuit 322 and a control signal transmitted from the controller 100. The hold circuit 323 holds the output signal from the AND circuit 322, which means the source data signal (SD). When the source start signal (SST) is transferred to the digital circuit 321*k* located in the final stage, the above operation is carried out in each drive circuit 320, and the data for one horizontal line is stored in the hold circuit 323, a control signal is output from the timing controller 120, and hold circuits 323*a* through 323*k* output source data signals (SD) which were held to buffer circuits 324*a* through 324*k* respectively.

Figure 12:
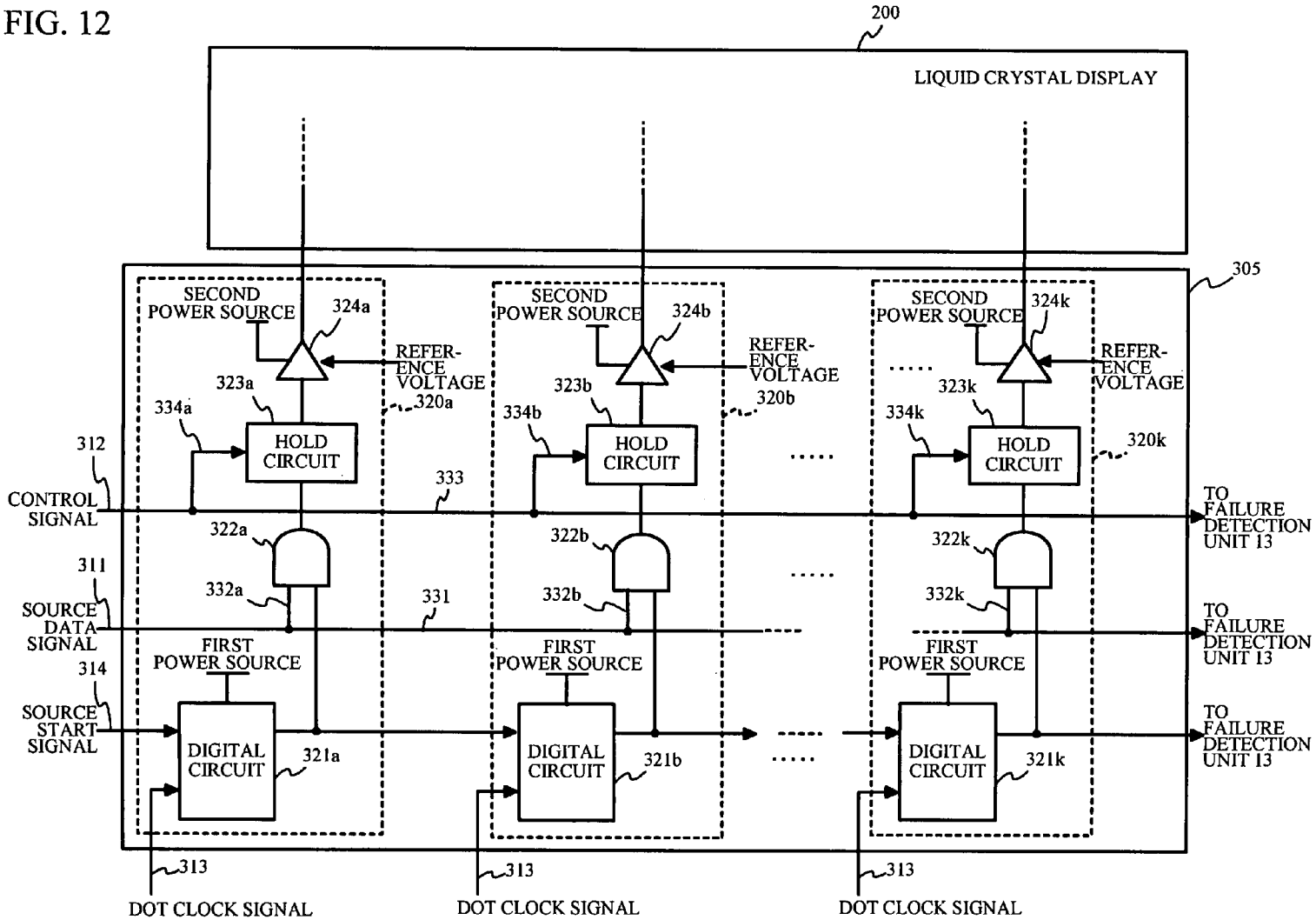
FIG. 12 is a diagram illustrating structures of source driver ICs.

In FIG. 12, a configuration where the AND circuit 322 is provided is illustrated, but a configuration without the AND circuit 322 is possible. In this case, signals input to the hold circuit 323 are an output signal of the digital circuit 321 and the source data signal (SD). In addition, a control signal is also input to the hold circuit 323. The hold circuit 323 holds the source data signal (SD) in response to the signal output timing of the digital circuit 321.

The buffer circuit 324 receives the output signal of the hold circuit 323 (source data signal (SD)). In addition, a reference voltage and a second power source are supplied to the buffer circuit 324. The second power source is a power source for operating the buffer circuit 324. The reference voltage is a voltage compared with a voltage of the source data signal input from the hold circuit 323. The buffer circuit 324 is provided with a D/A converter. The buffer circuit 324 calculates a difference between the input source data signal (SD) (digital) and the reference voltage, and generates an analog drive signal in accordance with the calculated difference. The buffer circuit 324 outputs the generated drive signal to the source line.

The dot clock signal (DCL) transmitted from the controller 100 via the control line 313 is divided in the wiring inside the source driver IC 305, and supplied to digital circuits 321*a* through 321*k* as illustrated in FIG. 12. In addition, the source start signal (SST) transmitted from the controller 100 via the control line 314 is supplied to only the digital circuit 321*a* inside the source driver IC 305. When the digital circuit 321*a* normally operates, the output signal of the digital circuit 321*a* to which the source start signal (SST) is input is transmitted to a digital circuit 321*b* located in the subsequent stage in synchronization with the dot clock signal (DCL). The digital circuit 321 to which the output signal from the digital circuit 321 located in the previous stage is input operates in synchronization with the dot clock signal (DCL), and transmits the output signal to the digital circuit 321 located in the subsequent stage. The output signal of the digital circuit 321*k* located in the final stage is transmitted to the controller 100 via the data line 315 as the source start return signal (SSTR).

The wiring for transmitting the source data signal (SD) to the AND circuit 322 inside the source driver IC 305 includes a main line 331 and branch lines 332*a* through 332*k* which diverge from the main line 331, and connects diverged branch lines 332*a* through 332*k* to respective AND circuits 322. In the same manner, the wiring for transmitting the control signal to the hold circuit 323 inside the source driver IC 305 includes a main line 333 and branch lines 334*a* through 334*k* which diverge from the main line 333, and the diverged branch lines 334*a* through 334*k* are connected to respective hold circuits 323. Wirings (main lines 331 and 333) used for transmitting the source data signal (SD) and the control signal may be extracted to the output port of the source driver IC 305, and may transmit the source data signal (SD) and the control signal to the failure detection unit 130. This allows the failure detection unit 130 to detect the abnormality in the source data signal (SD), the control signal, and data lines used for transmitting these signals.

Figure 13:
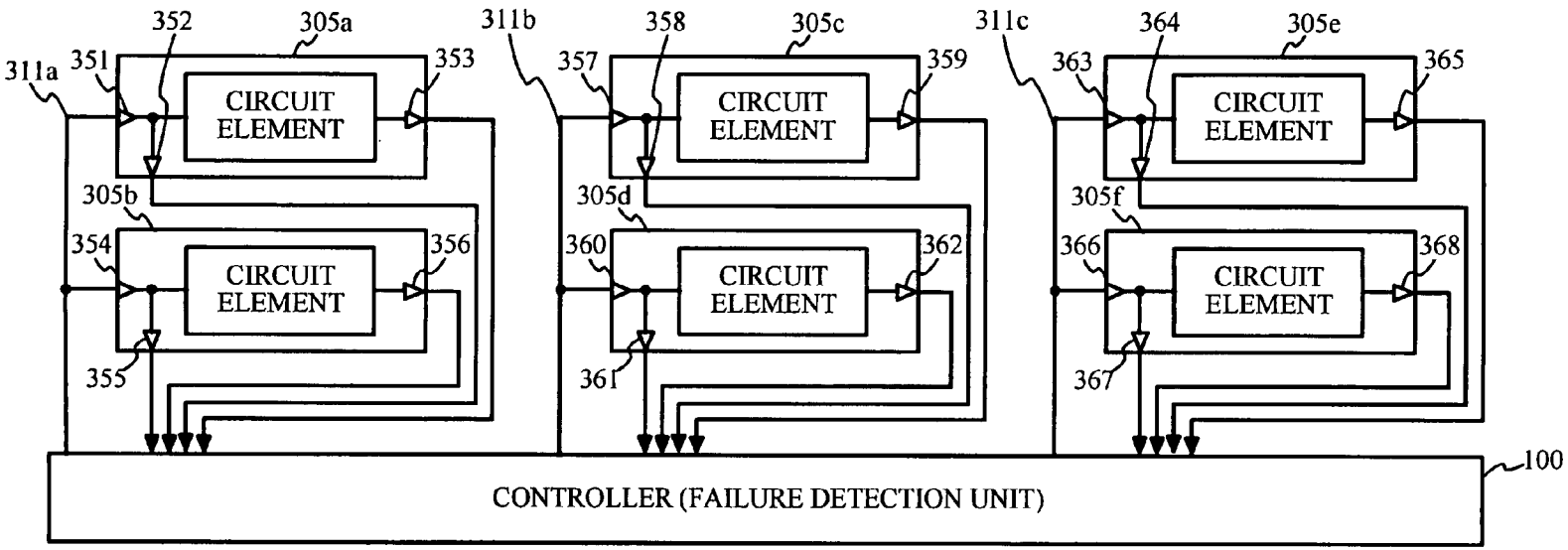
FIG. 13 is a diagram illustrating a circuit structure detecting a failure of the source driver IC.

FIG. 13 illustrates a signal wiring inside the source driver IC 305 for detecting the abnormality in the data line 311 used for transmitting the source data signal (SD), and a connection structure between the source driver IC 305 and the controller 100. In FIG. 13, other data lines illustrated in FIG. 10 are omitted.

In FIG. 13, six source driver ICs 305*a*, 305*b*, 305*c*, 305*d*, 305*e* and 305*f* are illustrated as the source driver IC 305.

The source driver ICs 305*a* and 305*b* receive the supply of the source data signal (SD) by a common data line 311*a*. Source driver ICs 305*c* and 305*d* receive a supply of the source data signal (SD) by a common data line 311*b*. In the same manner, source driver ICs 305*e* and 305*f* receive a supply of the source data signal (SD) by a common data line 311*c*. The source data signal (SD) supplied to source driver ICs 305*a* through 305*f* by data lines 311*a* through 311*c* is an identical signal.

For example, the wiring is configured so that the source driver IC 305*a* outputs the source data signal (SD) to a circuit element (here, the AND circuit 322 illustrated in FIG. 12) inside the source driver IC 305*a* and to an output port 352 at the input side separately located when the source data signal (SD) transmitted via the data line 311*a* is input to an input port 351. The source data signal (SD) output to the output port 352 is returned to the controller 100. It is possible to determine whether the source data signal (SD) is transmitted to the source driver IC 305 normally by obtaining the source data signal (SD) in the controller 100 and determining whether an error exists in the obtained data. The source driver IC 305*a* and the source driver IC 305*b* are supplied with the source data signal (SD) by the common data line 311*a*. Thus, when the controller 100 detects the abnormality in a signal output from the output port 352 of the source driver IC 305*a*, it determines that there is an abnormality in the data line 311*a*, and stops the operation of the source driver IC 305*a* and the source driver IC 305*b*. In the same manner, when the signal abnormity is detected at the input side of the source driver IC 305*c* or 305*d*, the controller 100 stops the operation of the source driver IC 305*c* and the source driver IC 305*d* connected to the common data line 311*b*. This applies to the source driver IC 305*e* and the source driver IC 305*f*.

An output port 353 that returns the source data signal (SD) that passed through circuit elements to the controller 100 is provided to the output side of the source driver IC 305*a*. It is possible to determine whether the source data signal (SD) is supplied to each circuit element by transmitting the source data signal (SD) that passed through circuit elements to the controller 100. In the example illustrated in FIG. 13, two pairs of source driver ICs 305 are connected via the common data line 311, but the structure where each source driver IC 305 is connected via data line 311 may be possible.

In the example illustrated in FIG. 13, although a configuration detecting the abnormality of the data line 311 used for transmitting the source data signal (SD) is described, it is possible to determine whether there is an abnormality in a control signal or a data line used for transmitting the control signal by the same wiring structure as FIG. 13.

Figure 14:
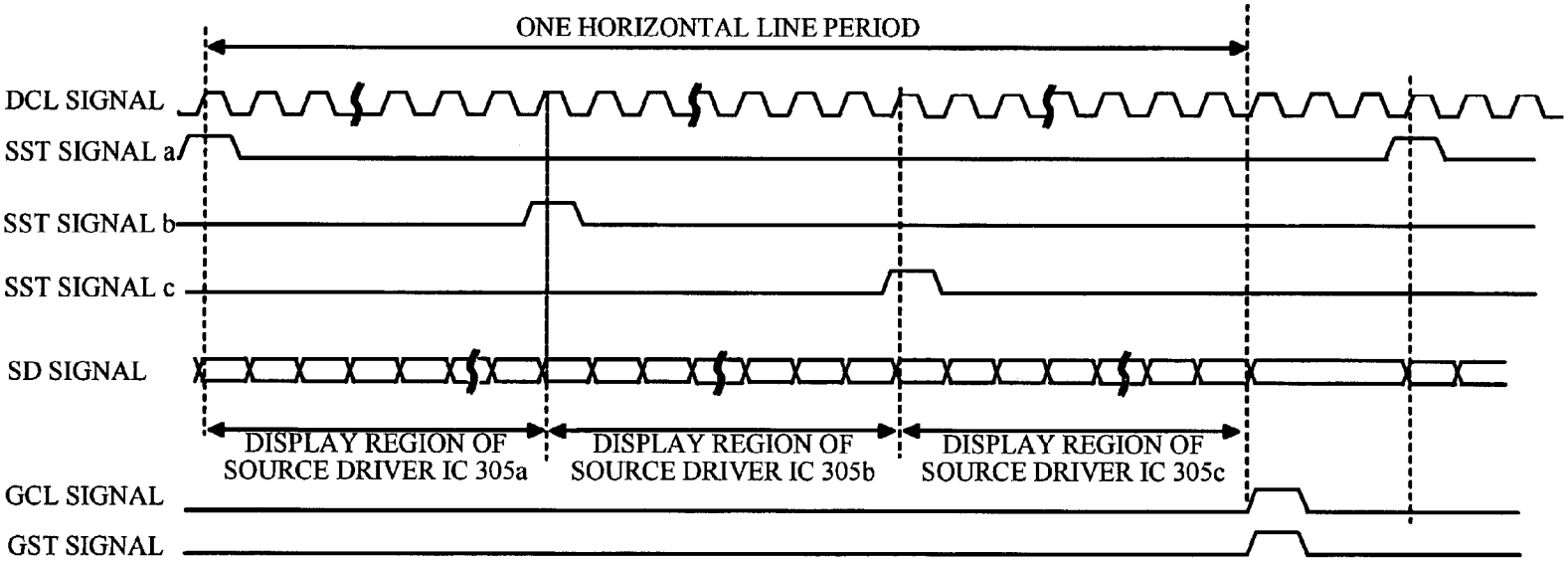
FIG. 14 is a diagram illustrating signal waveforms output from the controller to the source driver circuit.

A description will now be given of an operation timing of the source driver IC 305 with reference to FIG. 14. Signal waveforms of one horizontal line output from the controller 100 to source driver IC 305*a* through 305*c* are illustrated in FIG. 14.

In this embodiment, a description will be given of a case where an image is displayed from the left side of the screen illustrated in FIG. 9. The controller 100 supplies the source start signal (SST signal a illustrated in FIG. 14) to the source driver IC 305*a*. The dot clock signal (DCL) is supplied from the controller 100 to the source driver IC 305*a*, the source driver IC 305*b* and the source driver IC 305*c* via the control line 313.

In the source driver IC 305*a* supplied with the source start signal (SST signal a), the digital circuit 321*a* inside the source driver IC 305*a* outputs an output signal at high level to the AND circuit 322*a* and the digital circuit 321*b* located in the subsequent stage in synchronization with the rising timing of the source start signal (SST signal a) and the dot clock signal (DCL). When the output signal of the digital circuit 321*a* becomes at high level, the source data signal (SD) is output from the AND circuit 322*a* to the hold circuit 323*a*, and the signal level of the source data signal (SD) is held in the hold circuit 323*a*. When the source start signal (SST) is at low level, the output signal of the digital circuit 321*a* becomes at low level. Therefore, the source data signal (SD) is not imported to the hold circuit 323*a*.

The digital circuit 321*b* turns the output signal to high level in synchronization with the next rising timing of the dot clock signal (DCL). According to this, the signal level of the source data signal (SD) is held in the hold circuit 323*b* of the drive circuit 320*b*. Then, in the same manner, the signal level of the source data signal (SD) is held in the hold circuit 323*c* through 323*k* in synchronization with the rising timing of the dot clock signal (DCL).

When the writing of the source data to the source driver IC 305*a* is finished, the controller 100 outputs the source start signal (SST signal b illustrated in FIG. 14) to the source driver IC 305*b*. In the source driver IC 305*b* to which the source start signal (SST signal b) is input, the source data signal (SD) is held in hold circuits 323*a* through 323*k* sequentially in synchronization with the rising timing of the dot clock signal (DCL) in the same manner as the source driver IC 305*a*.

In the same manner, the source driver IC 305*c* starts the operation in synchronization with the rising timing of the source start signal (SST signal c), and holds the signal level of the source data signal (SD) in hold circuits 323*a* through 323*k* sequentially in synchronization with the rising timing of the dot clock signal (DCL).

When data for one line in a horizontal direction is held in hold circuits 323*a* through 323*k* of source driver ICs 305*a* through 305*c*, the controller 100 switches the signal level of the control signal to high level. When the control signal becomes at high level, hold circuits 323*a* through 323*k* output held signal levels to buffer circuits 324*a* through 324*k*. Buffer circuits 324*a* through 324*k* output drive signals in accordance with differences between the output signal levels of hold circuits 323*a* through 323*k* and the reference voltage to respective source lines.

After that, the controller 100 outputs the gate start signal (GST) to the gate driver IC 405 that drives a gate line. The gate driver IC 405 to which the gate start signal (GST) is input outputs the drive signal to the gate line at the timing of when the signal level of the input gate clock signal (GCL) becomes high level.

A description will now be given of the liquid crystal display 200 with reference to FIGS. 15 and 16.

Figure 15:
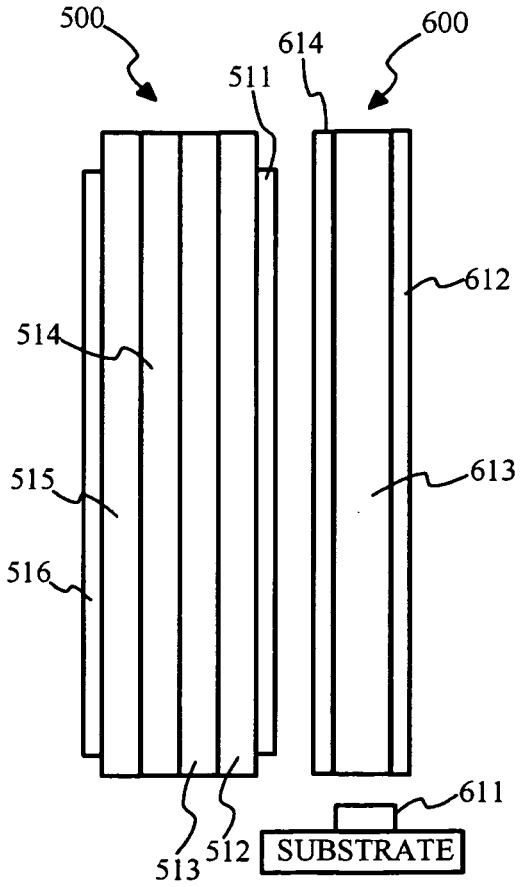
FIG. 15 is a diagram illustrating a structure of a liquid crystal display.

The liquid crystal display 200 is provided with a liquid crystal unit 500, and a backlight unit 600 for lighting the liquid crystal unit 500 as illustrated in FIG. 15. The liquid crystal unit 500 is located at the front surface side of the backlight unit 600, which means that it is located to face the emitting surface from which the light is emitted.

As illustrated in FIG. 15, the liquid crystal unit 500 is provided with a polarizing plate 511, a TFT substrate 512, a liquid crystal layer 513, a color filter substrate 514 having pixels of three primary colors of RGB, a glass substrate 515, a polarizing plate 516 and the like in this order from the backlight unit 600 side, for example.

The backlight unit 600 is provided with a light source 611 such as LED, a light guide plate 613 for guiding a light, a reflection plate 612 that reflects the irradiated light from the light source 611 to the light guide plate 613, an optical film 614 for diffusing the output light from the light guide plate 613 and the like.

Figure 16:
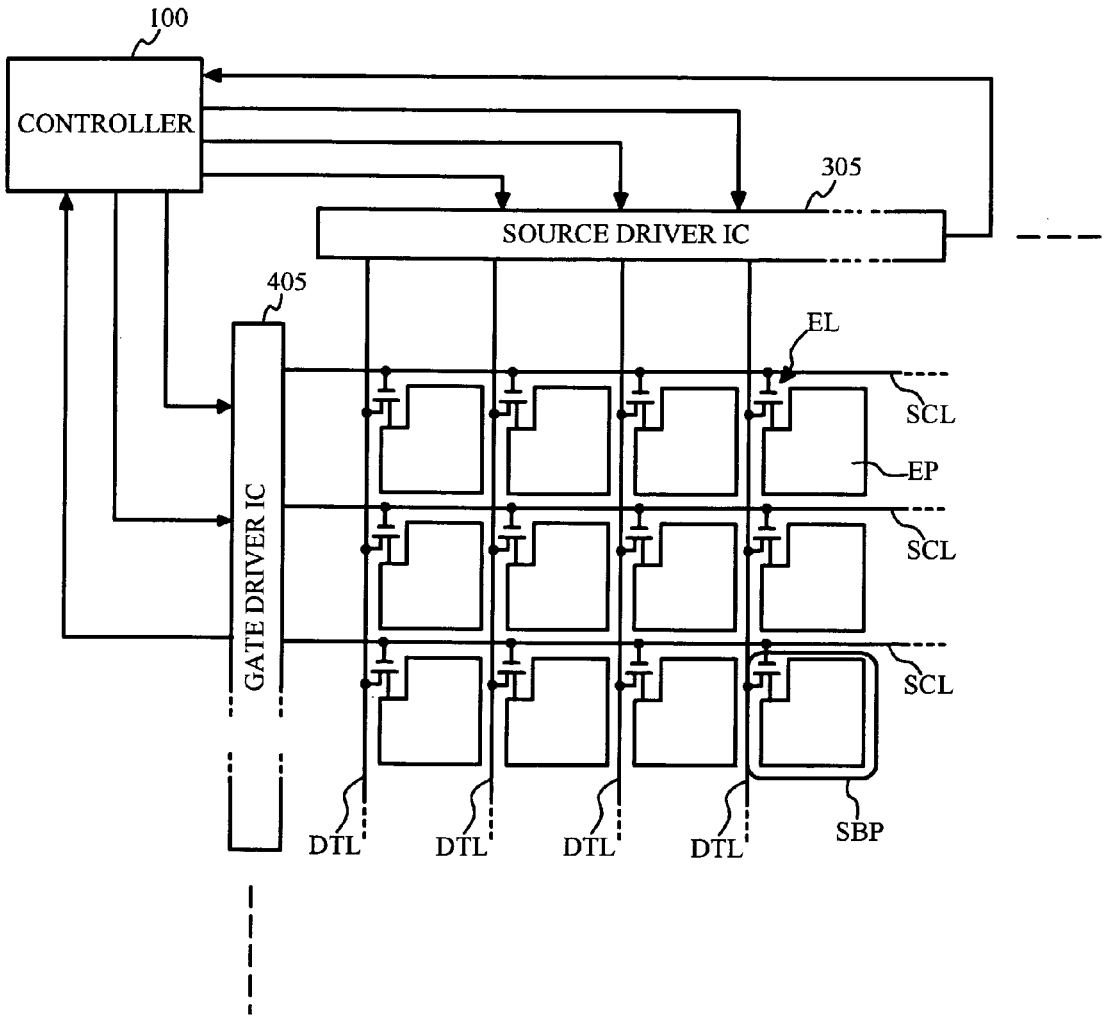
FIG. 16 is a diagram illustrating a circuit structure of a TFT substrate.

The TFT substrate 512 is provided with the source driver circuit 300, the gate driver circuit 400, gate lines SCL aligned in a vertical direction, source lines DTL aligned in a horizontal direction, TFT elements EL (image elements) formed with respect to regions where gate lines SCL and source lines DTL intersect, pixel electrodes EP formed to correspond to TFT elements EL, and the like as illustrated in FIG. 16, and each region surrounded by the gate line SCL and the source line DTL forms a pixel SBP.

A description will now be given of an operation after the failure is detected by the failure detection unit 130. If the failure detection unit 130 detects the failure, it notifies the timing controller 120 and the image processing unit 110 of the source driver IC 305 or gate driver IC 405 where the failure occurs. The timing controller 120 which receives the notification of the failure stops the output of the source start signal (SST) to the source driver IC 305 where the failure is detected. In the same manner, the timing controller 120 stops the output of the gate start signal (GST) to the gate driver IC 405 where the failure is detected. The image processing unit 110 may display a black image to the source driver IC 305 and the gate driver IC 405 where the failure is detected. That is to say, the image processing unit 110 reduces the original image to be displayed on the liquid crystal display 200, and displays the black image to the source driver IC 305 and the gate driver IC 405 where the failure is detected, instead of displaying the image. The configuration for outputting a black image to the source driver IC 305 and the gate driver IC 405 where the failure is detected is described later with reference to FIG. 22.

Figure 17:
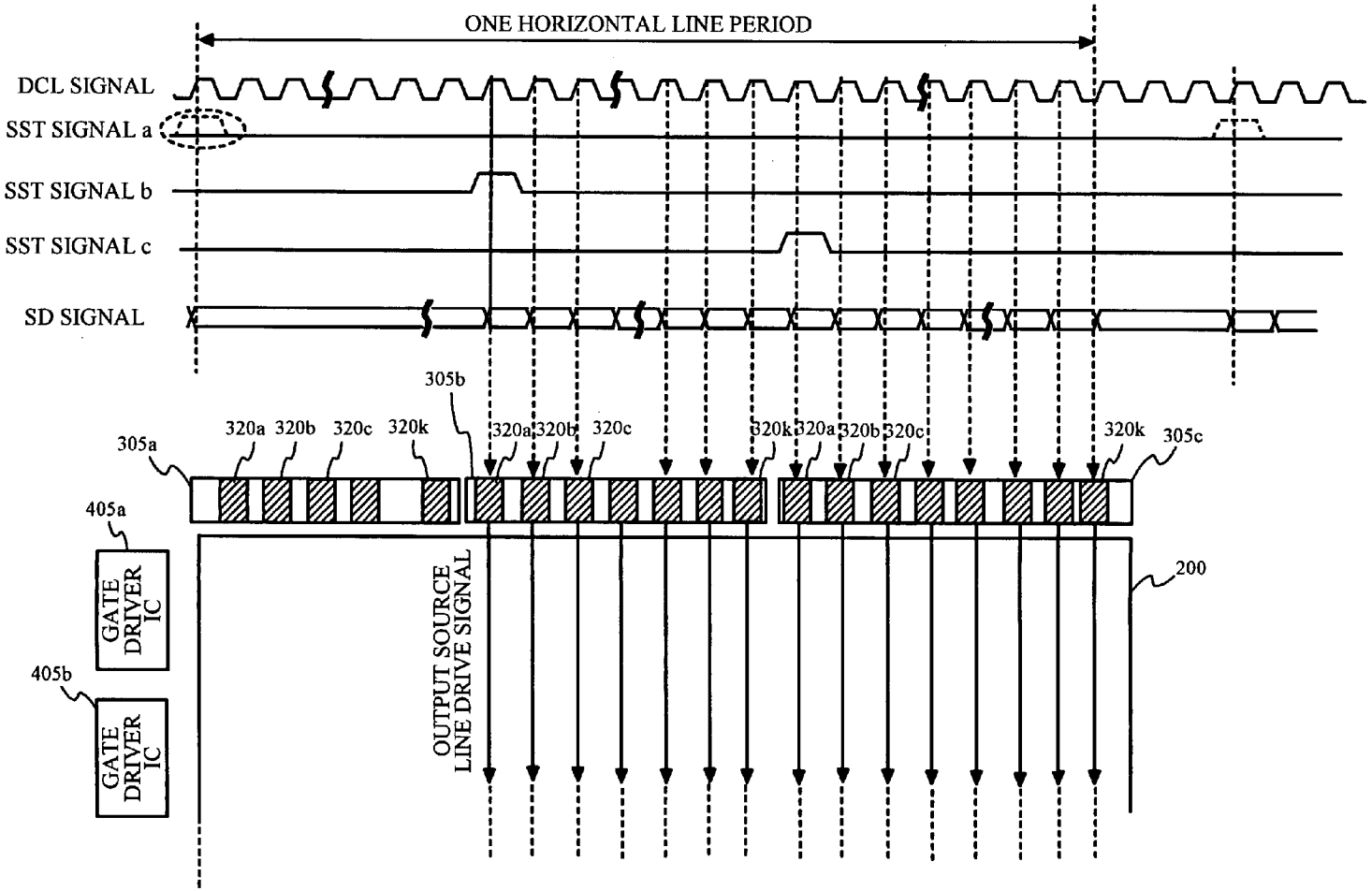
FIG. 17 is a diagram illustrating, in a case where a failure occurs in the source driver IC, signals output from the controller to the source driver circuit and how the information is displayed by restricting a display region of the liquid crystal display due to the failure.

A description will be given of an operation of the controller 100 after the failure is detected by the failure detection unit 130 with reference to FIG. 17. FIG. 17 illustrates signals output from the controller 100 when the failure occurs in the source driver IC 305*a*. In addition, FIG. 17 illustrates the liquid crystal display 200 and the source driver IC 305 and the gate driver IC 405 located around the liquid crystal display 200, and illustrates the drive of the source line of the liquid crystal display 200. Inside the source driver IC 305, the drive circuit 320 that outputs the drive signal is illustrated simplistically.

Assume that the failure is detected in the source driver IC 305*a*. When the failure is detected in the source driver IC 305*a*, the controller 100 (the timing controller 120) does not output the source start signal (SST signal a) to the source driver IC 305*a* even though the timing for operating the source driver IC 305*a* comes (SST signal a is illustrated with dashed lines in FIG. 17). The source driver IC 305*a* does not start the operation because it cannot receive the source start signal (SST signal a). Therefore, as illustrated in FIG. 17, the drive signal is not output to source lines of the region where the source driver IC 305*a* handles the display.

When the controller 100 determines that the operation start timing of the source driver IC 305*b* comes based on the count of the dot clock signal (DCL), it outputs the source start signal (SST signal b illustrated in FIG. 17) to the source driver IC 305*b* via the control line 314*b*. Drive circuits 320*a* through 320*k* inside the source driver IC 305*b* to which the source start signal (SST signal b) is input hold the source data signal (SD) in hold circuits 323*a* through 323*k* sequentially in synchronization with the dot clock signal (DCL). In the same manner, the controller 100 outputs the source start signal (SST signal c) to the source driver IC 305*c*. Drive circuits 320*a* through 320*k* inside the source driver IC 305*c* to which the source start signal (SST signal c) is input hold the source data signal (SD) in hold circuits 323*a* through 323*k* sequentially in synchronization with the dot clock signal (DCL). Then, when the control signal output from the controller 100 becomes at high level, signals in accordance with signal levels of the source data signal (SD) held in hold circuit 323*a* through 323*k* inside the source driver IC 305*b* and the source driver IC 305*c* are output to buffer circuits 324*a* through 324*k*, and drive signals are output to respective source lines by buffer circuits 324*a* through 324*k*.

The source start signal (SST) and the source data signal (SD) that detect the failure in the source driver IC 305*a*, and that are supplied to the source driver IC 305*b* and the source driver IC 305*c* located in the subsequent stage correspond to the corrected source signal of the present invention.

Figure 18:
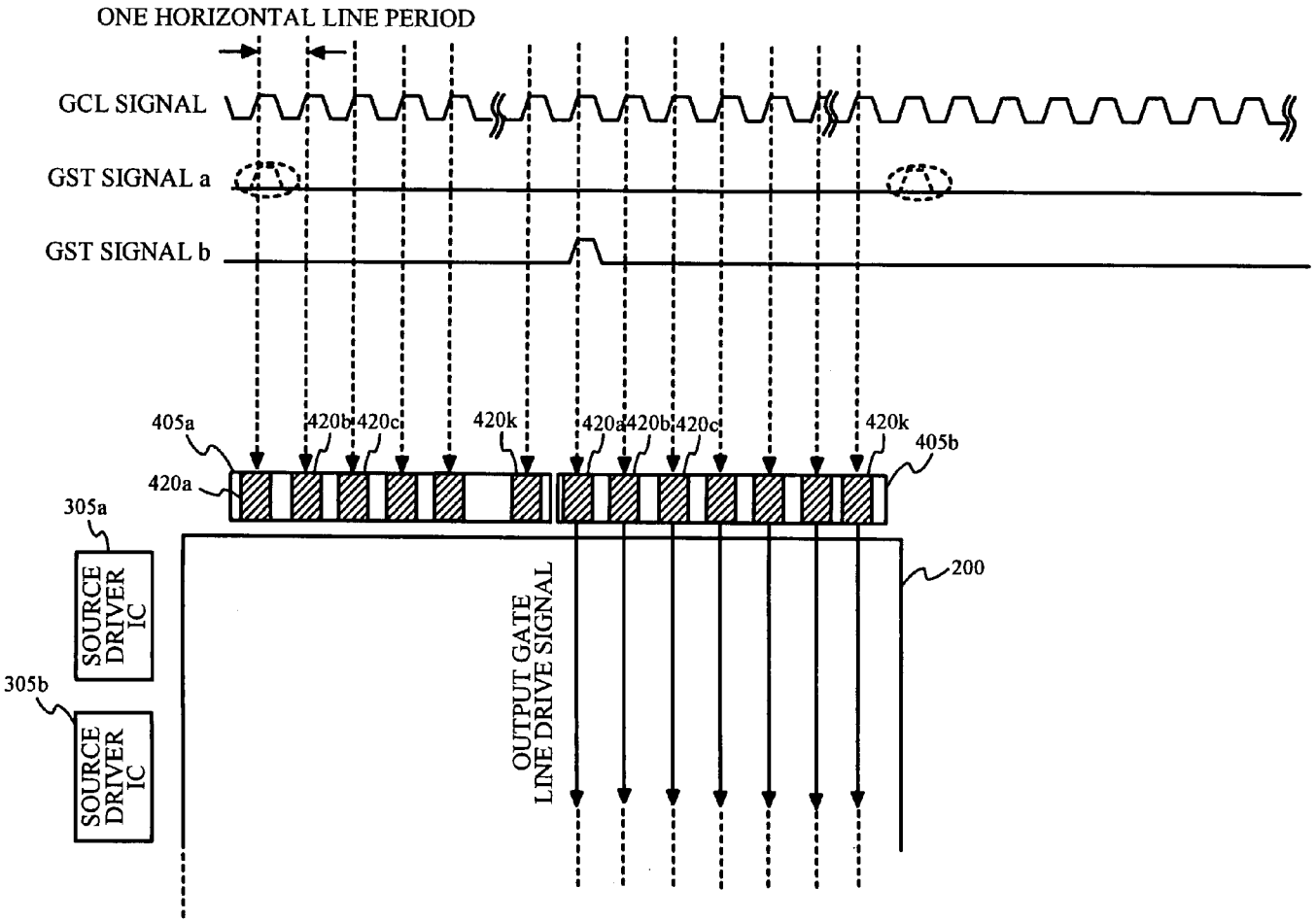
FIG. 18 is a diagram illustrating, in a case where a failure occurs in the gate driver IC, signals output from the controller to the source driver circuit and how information is displayed by restricting the display region of the liquid crystal display due to the failure.

FIG. 18 illustrates a signal output from the controller 100 when the failure occurs in the gate driver IC 405. The controller 100 does not output the gate start signal (GST) to the gate driver IC 405 where the failure is detected (the gate driver IC 405*a* in the example illustrated in FIG. 18) either when the failure is detected in the gate driver IC 405 as described above. This restricts the display region of the liquid crystal display 200. The gate start signal (GST) supplied from the controller 100 (the timing controller 120) to the gate driver IC 405*b* located in the subsequent stage of the gate driver IC 405*a* where the abnormality is detected, and the gate clock signal (GCL) correspond to a corrected gate signal of the present invention.

Figure 19:
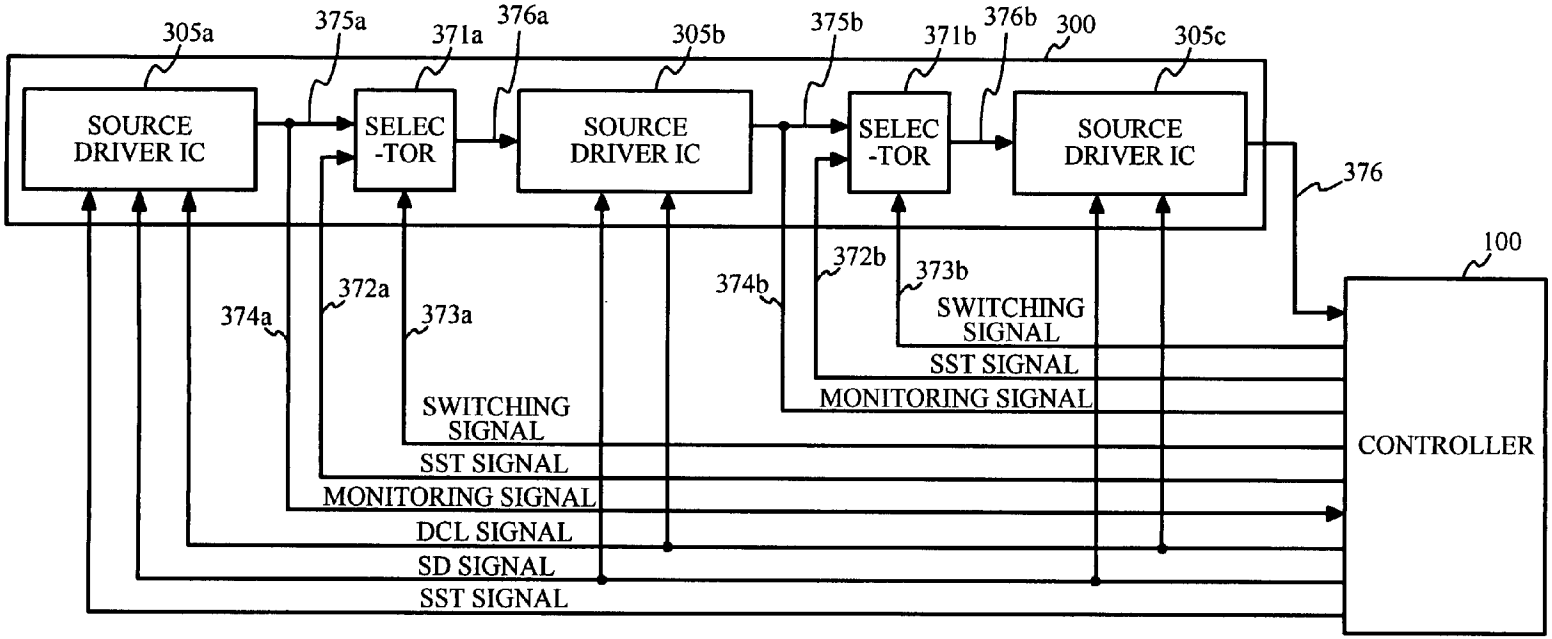
FIG. 19 is a diagram illustrating another connection configuration between the source driver circuit and the controller.
Figure 20:
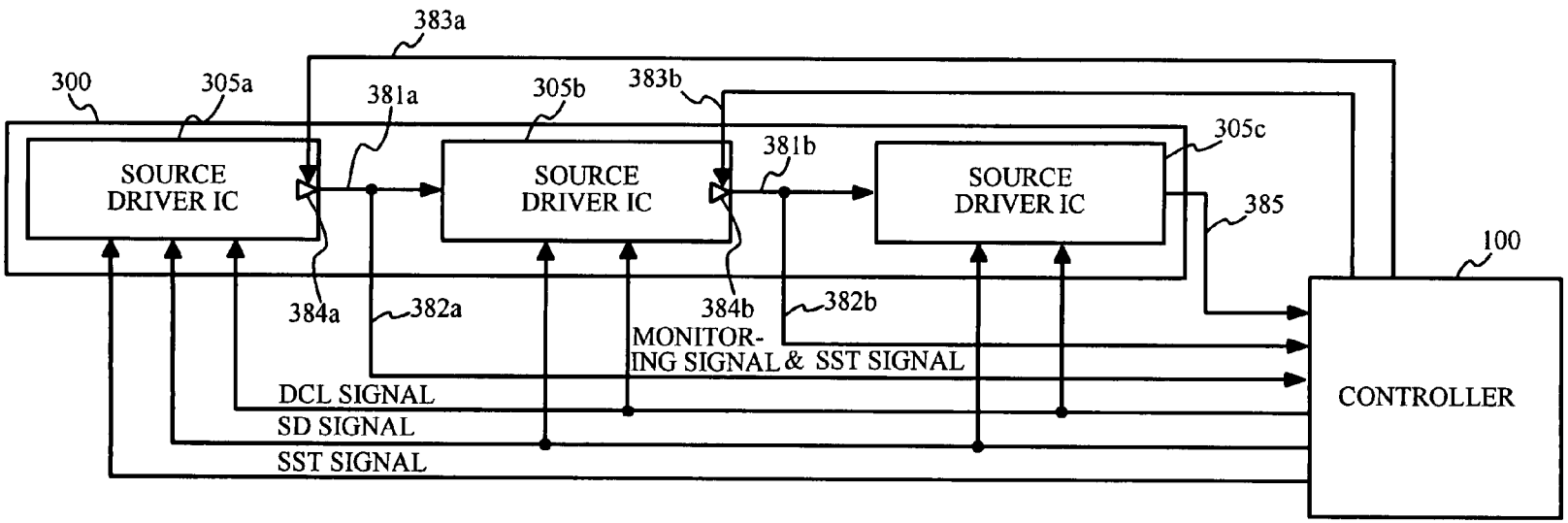
FIG. 20 is a diagram illustrating another connection configuration between the source driver circuit and the controller.
Figure 21:
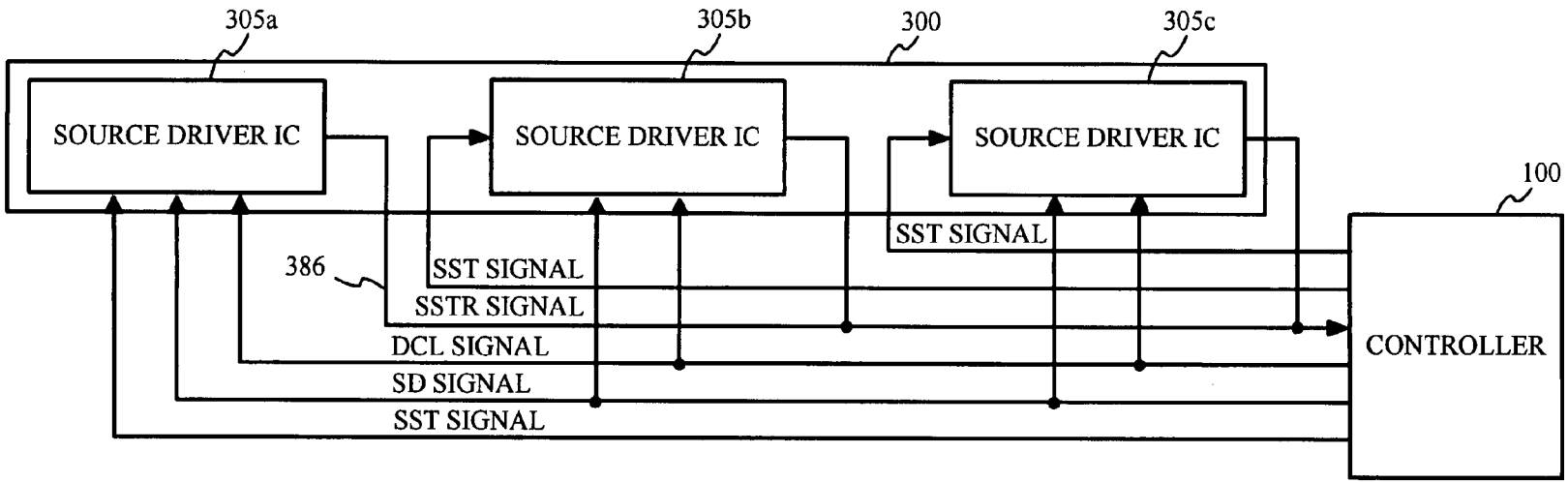
FIG. 21 is a diagram illustrating another connection configuration between the source driver circuit and the controller.

The configuration of the wiring connecting the controller 100 and source driver ICs 305*a* through 305*c* may be configurations illustrated in FIG. 19 through FIG. 21. Hereinafter, a description will be given of these configurations.

In an example illustrated in FIG. 19, a selector 371*a* is provided between the source driver IC 305*a* and the source driver IC 305*b*. In the same manner, a selector 371*b* is provided between the source driver IC 305*b* and source driver IC 305*c*.

In configurations illustrated in FIG. 19 and FIG. 20 described next, the signal output from the source driver IC 305*a* is not returned to the controller 100 as the source start return signal (SSTR), and the signal output from the source driver IC 305*a* is transmitted to the source driver IC 305*b* located in the subsequent stage as the source start signal (SST). In the same manner, the signal output from the source driver IC 305*b* is transmitted to the source driver IC 305*c* located in the subsequent stage as the source start signal (SST).

The selector 371*a* is connected to the source driver IC 305*a* via a data line 375*a*. The selector 371*a* is connected to the source driver IC 305*b* via a data line 376*a*. The selector 371*a* is connected to the controller 100 via a control line 373*a* and a data line 372*a*.

In the same manner, the selector 371*b* is connected to the source driver IC 305*b* via a data line 375*b*. The selector 371*b* is connected to the source driver IC 305*c* via a data line 376*b*. The selector 371*b* is connected to the controller 100 via a control line 373*b* and a data line 372*b*.

The source start signal (SST) is output from the source driver IC 305*a* to the selector 371*a*. A data line 374*a* connected to the controller 100 is connected to the data line 375*a* connecting the source driver IC 305*a* and the selector 371*a*. The controller 100 monitors the source start signal (SST) output from the source driver IC 305*a* by the data line 374*a* connected to the data line 375*a*. When the controller 100 determines that the source start signal (SST) is not output from the source driver IC 305*a*, it outputs the switching signal to the selector 371*a*, and switches the input destination of the signal of the selector 371*a*. The selector 371*a* receives the signal from data line 372*a* connected to the controller 100 instead of the data line 375*a* based on the switching signal from the controller 100. When the controller 100 outputs the switching signal to the selector 371*a*, it outputs the source start signal (SST) to the data line 372*a*. The selector 371*a* outputs the source start signal (SST), which is supplied from the controller 100, to the source driver IC 305*b*.

As the switch of the selector 371*b* is executed in the same manner as the selector 371*a*, a description will be omitted.

In a wiring example illustrated in FIG. 20, a data line 381*a* transmitting the source start signal (SST) from the source driver IC 305*a* to the source driver IC 305*b* is connected to a data line 382*a* connected to the controller 100. In the same manner, a data line 381*b* transmitting the source start signal (SST) from the source driver IC 305*b* to the source driver IC 305*c* is connected to a data line 382*b* connected to the controller 100. In addition, a control line 383*a* connected to the controller 100 is connected to a driver 384*a* of the source driver IC 305*a* outputting the source start signal (SST) to the data line 381*a*. In the same manner, a control line 383*b* connected to the controller 100 is connected to a driver 384*b* of the source driver IC 305*b* outputting the source start signal (SST) to the data line 381*b*.

The controller 100 receives and monitors the source start signal (SST) output from the source driver IC 305*a* to the source driver IC 305*b* via the data line 382*a*. When the controller 100 determines that the source start signal (SST) is not output from the source driver IC 305*a* to the source driver IC 305*b*, it outputs a signal that prohibits the output of the driver 384*a* to the driver 384*a* via the control line 383*a*. The driver 384*a* which receives the signal from the controller 100 stops the output of the source start signal (SST) to the data line 381*a*. In addition, when the controller 100 prohibits the output of the source start signal (SST) from the source driver IC 305*a* to the source driver IC 305*b*, it outputs the source start signal (SST) to the source driver IC 305*b* via the data line 382*a*. That is to say, data lines 382*a* and 382*b* are bi-directional data lines, and transmit the monitoring signal of the source start signal (SST) output from the source driver IC 305, to the controller 100. In addition, data lines 382*a* and 382*b* transmit the source start signal (SST), which is output from the controller 100, to the source driver IC 305.

The controller 100 executes a same process as the process described above when the source start signal (SST) is not output from the source driver IC 305*b* to the source driver IC 305*c*.

In a connection example of the wiring illustrated in FIG. 21, output sides of source driver ICs 305*a*, 305*b* and 305*c* are connected via a data line 386 connected to the controller 100. The source start return signal (SSTR) output from each of source driver ICs 305*a* through IC305*c* is transmitted to the controller 100 via the data line 386.

As the timing on when the source driver IC 305 should output the source start return signal (SSTR) is determined, the controller 100 can determine which source driver IC 305 outputs the signal on the basis of the input timing of the source start return signal (SSTR).

In addition, the configuration of the wiring connecting the controller 100 and gate driver ICs 405*a* through 405*b* may be a configuration same as the configuration of the wiring connecting the controller 100 and source driver ICs 305*a* through 305*c* illustrated in FIG. 19 through FIG. 21 (the configuration where the parts corresponding to the SST signal are replaced with parts corresponding to GST signal).

Figure 22:
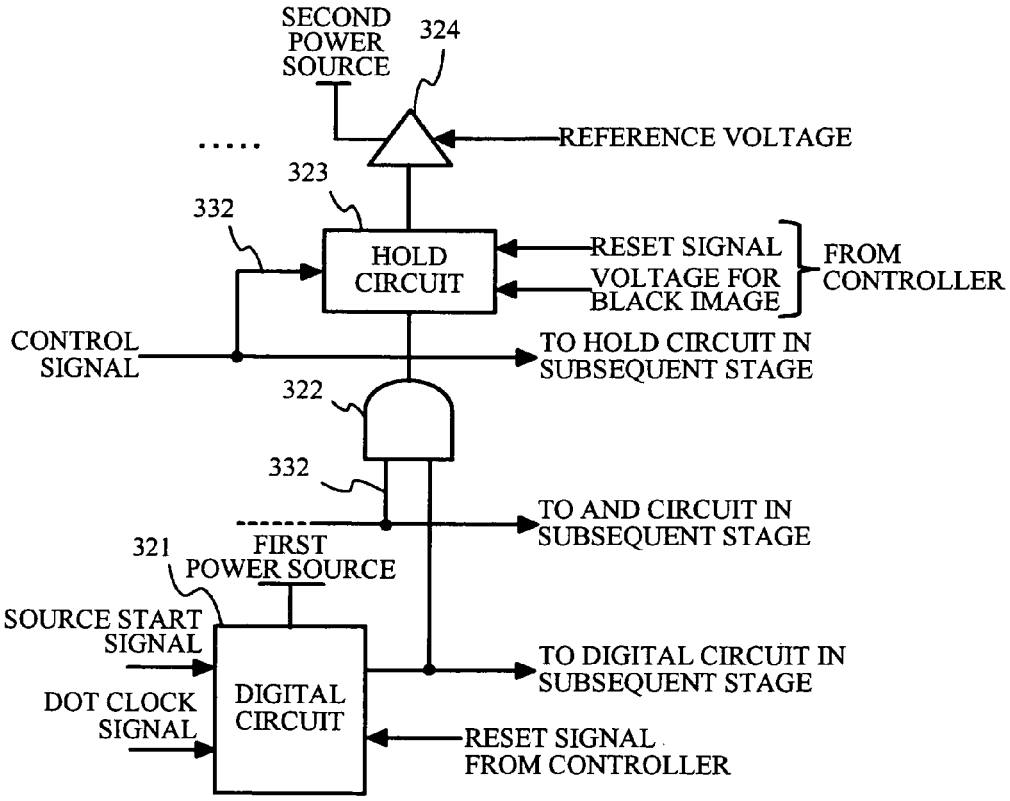
FIG. 22 is a diagram illustrating a structure of a drive circuit outputting a black image.

A description will now be given of the configuration for making source driver ICs 305*a* through 305*c* where the failure occurs output the black image, with reference to FIG. 22.

If the output state of the source driver IC 305 where a failure occurs is not defined, the display is disturbed on the liquid crystal display 200 that the source driver IC 305 handles. For example, the display where the black image and the white image are mixed is presented. Hence, as illustrated in FIG. 22, when the controller 100 detects a failure in the source driver IC 305, it outputs a reset signal to the hold circuit 323 and the digital circuit 321 of the source driver IC 305 where the failure is detected.

When the hold circuit 323 receives the reset signal from the controller 100, it stops the input of the output signal of the AND circuit 322, and receives a signal for outputting the black image output from the controller 100. As the buffer circuit 324 converts the signal output from the hold circuit 323 into the analog signal, and outputs it to the source line as a drive signal, the black image is displayed on the liquid crystal display 200.

In addition, the controller 100 makes the digital circuit 321 stop the operation by outputting the reset signal to the digital circuit 321. The power consumption of the display device 1000 can be reduced by making the digital circuit 321 stop the operation.

As it is clear from the above description, according to the present embodiment, the failure of source driver ICs 305*a* through 305*c* can be easily determined by transmitting the source start signal (SST) to source driver ICs 305*a* through 305*c*, and determining whether the source start return signal (SSTR) is returned from source driver ICs 305*a* through 305*c* to which the source start signal (SST) was transmitted.

Moreover, as the source start signal (SST) that makes source driver ICs 305*a* through 305*c* operate is output from the controller 100 to source driver ICs 305*a* through 305*c* separately, it is possible to maintain the display by making other source driver ICs 305 operate even though a failure occurs in one of source driver ICs 305.

Moreover, in the configuration illustrated in FIG. 19 and FIG. 20, the processing load of the controller 100 can be reduced by supplying the source start signal (SST) from the controller 100 to the source driver IC 305 located in the subsequent stage of the source driver IC 305 where a failure is detected only when the failure is detected.

In the above-described embodiment, an example for handling the abnormality of the source start signal (SST) is described, however the same effect is achieved with the configuration where the abnormality of the signal relating to the generation of the source line signal (drive signal in the embodiment) such as a bit clock signal and a source data signal is detected, and the corrected signal which is to be transmitted under normal circumstances is supplied to the circuit located in the subsequent stage (drive circuits in the embodiment) in the same manner as the source start signal (SST).

Third Embodiment

A description will now be given of a backlight 2 and the backlight unit 600. Hereinafter, they are referred to as the backlight.

Figure 23A:
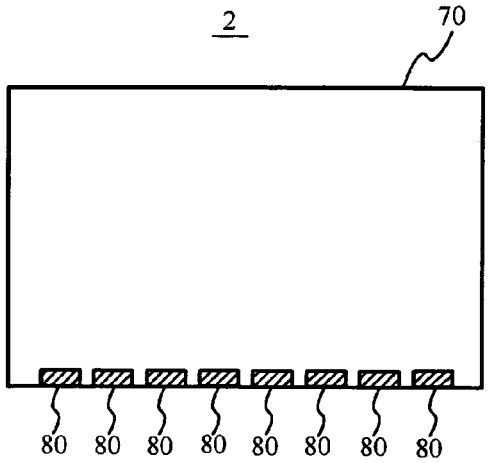
FIGS. 23A through 23C are explanatory diagrams of a backlight.
Figure 23B:
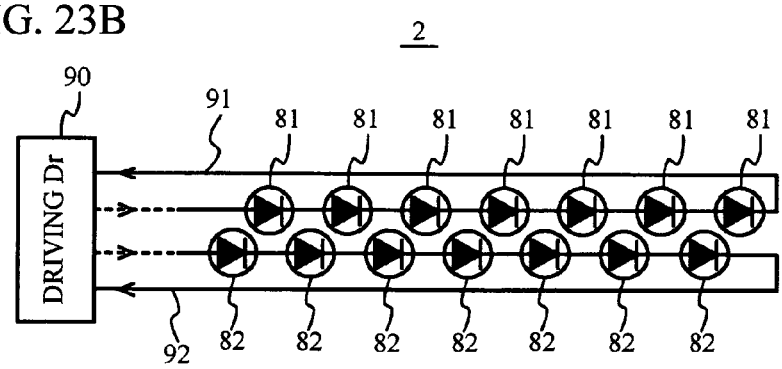
Figure 23C:
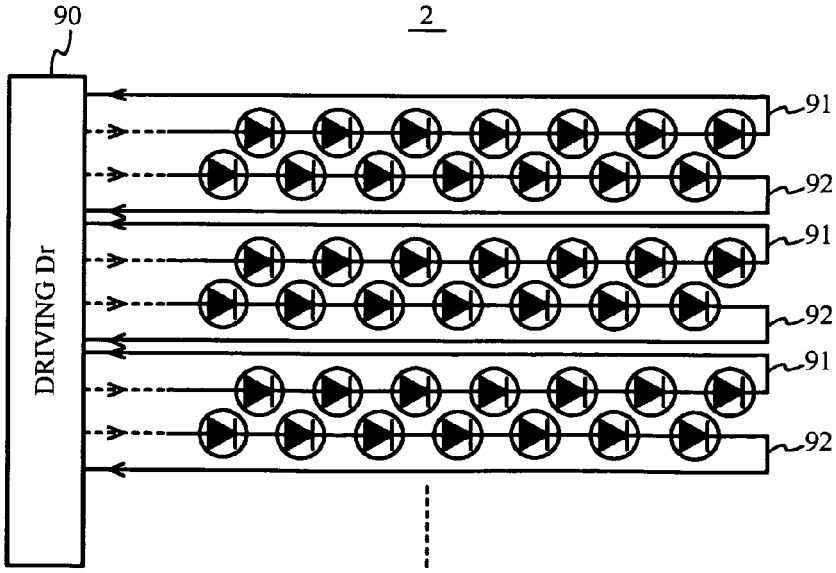

FIG. 23A through 23C are explanatory diagrams of the backlight 2, FIG. 23A is a schematic front view of the backlight 2, FIG. 23B is a diagram illustrating the electrical connection state of LEDs 80. FIG. 23C illustrates a state where LEDs are connected in series. In FIG. 23A through 23C, an illustration which is unnecessary for the description is omitted.

Figure 29:
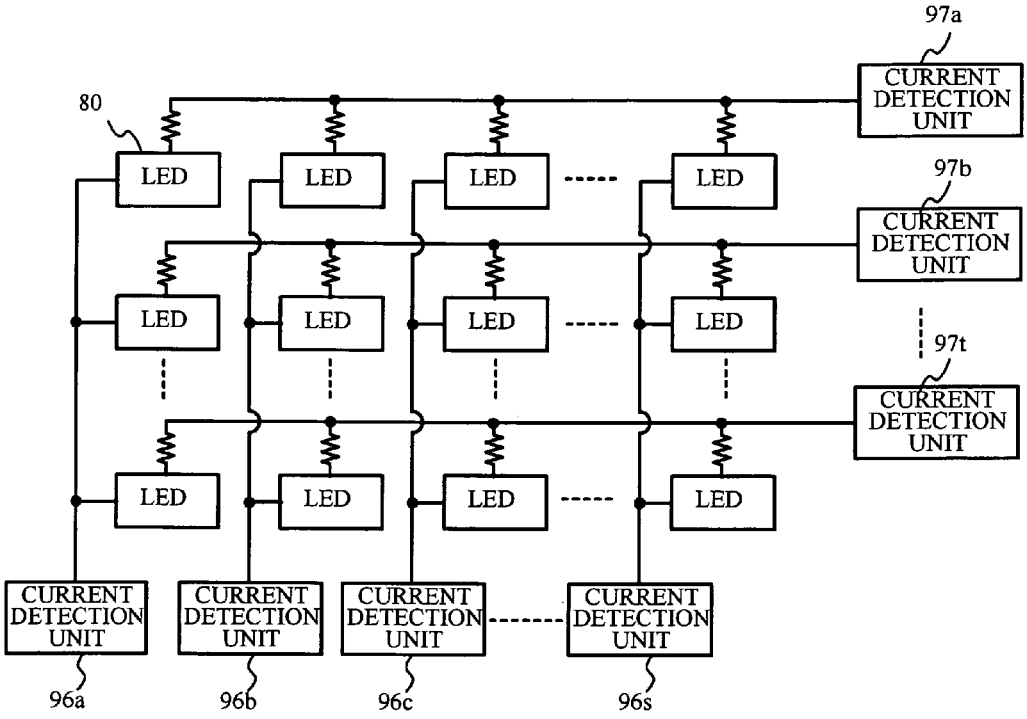
FIG. 29 is a configuration diagram of a backlight in accordance with a fifth variant example.

The backlight 2 includes the light guide plate 70 and LEDs 80. As illustrated in FIG. 23A, LEDs 80 are aligned on the one lateral side of the light guide plate 70. These LEDs 80 are composed of LEDs 81 and LEDs 82 as illustrated in FIG. 23B. In FIG. 23A and FIG. 23B, the number of LEDs 80 does not correspond to the total number of LEDs 81 and 82 for simplifying the illustration. Hereinafter, a case where LEDs 80 are aligned on the one lateral side of the light guide plate 70 will be described, but the configuration is not limited to this configuration. For example, it is possible to lay out LEDs 80 in a reticular pattern as illustrated in FIG. 29. Alternatively, it is possible to lay out LEDs on one surface of the light guide plate 70 by further increasing the number of LEDs 81 and LEDs 83 connected in series as illustrated in FIG. 23C.

LEDs 81 and 82 are driven by a driving driver 90. Current lines 91 and 92 are connected to the driving driver 90. Current lines 91 and 92 are independent of each other. The driving driver 90 supplies a current to current lines 91 and 92 separately. LEDs 81 are connected to the current line 91 in series. LEDs 82 are connected to the current line 92 in series.

The light source other than LED can be used as the light emitting unit.

Figure 24:
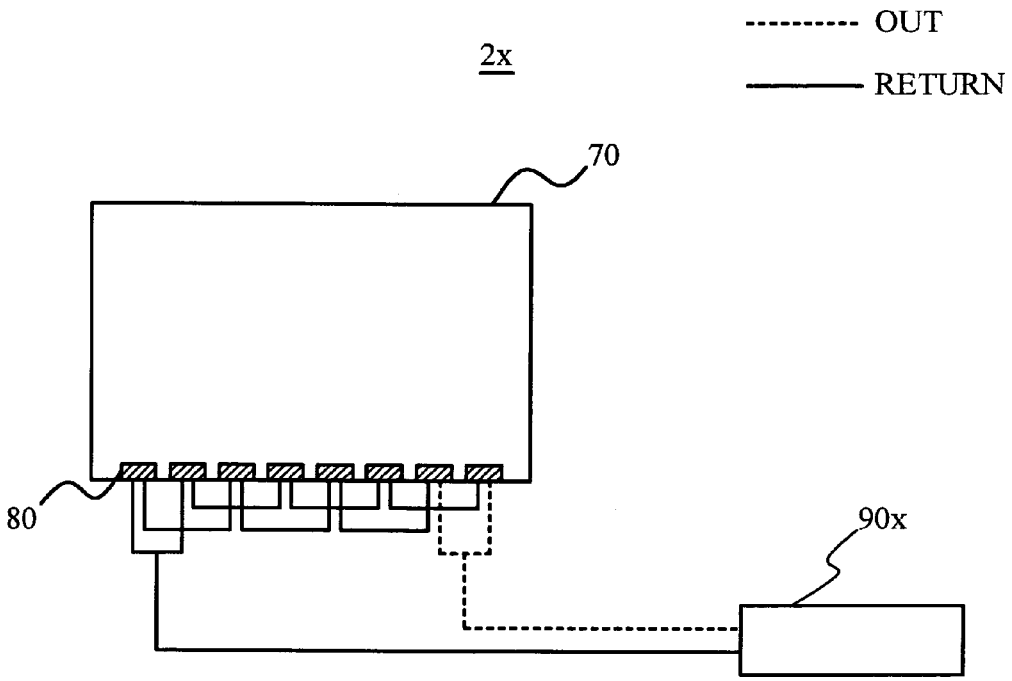
FIG. 24 is an explanatory diagram of a backlight having a different structure of the backlight in accordance with the present embodiment.

A description will be given of a backlight 2*x* which has a different configuration from the backlight 2 in accordance with the present embodiment. FIG. 24 is a configuration diagram of the backlight 2*x* having a different configuration from the backlight 2 in accordance with the present embodiment.

As illustrated in FIG. 24, a driving driver 90*x* is connected to LEDs 80 via current lines, and current lines are bundled in a group at the input side and the output side of the driving driver 90*x*. According to this, for example, when the current lines are disconnected at the location where current lines are bundled in a group, a current is not supplied to any of LEDs 80. Thus, any of LEDs 80 are not driven. Because of this, it is not possible to guide a light to the display panel 20, and the visibility of the display panel 20 decreases.

However, in the backlight 2 described above, when the current line 91 is disconnected for example, LEDs 81 are not driven, but LEDs 82 can be driven. Hence, although the brightness of the display panel 20 decreases compared to normal circumstances, the light can be guided to the display panel 20. This enables to maintain the display function of the display device 1000.

In addition, even in a case where a failure occurs in a part of LEDs 81 instead of a disconnection, if the current line 92 and LEDs 82 are normal, it is possible to guide a light to the display panel 20 by LEDs 82.

Figure 25:
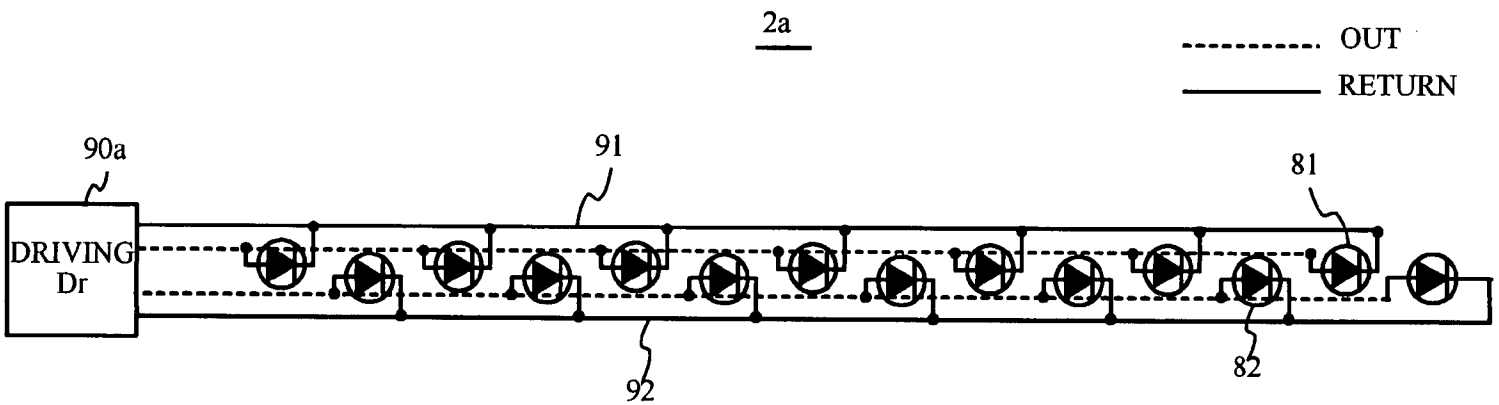
FIG. 25 is a configuration diagram of a backlight in accordance with a first variant example.

A description will now be given of backlights in accordance with variant examples. FIG. 25 is a configuration diagram of a backlight in accordance with a first variant example.

As illustrated in FIG. 25, LEDs 81 are connected to the current line 91 in parallel. In other words, LEDs 81 are connected to a driving driver 90*a* in parallel by the current line 91. The same is applied to the connection between the current line 92 and LEDs 82.

For example, even though a failure occurs in a part of LEDs 81, LEDs 81 are connected to the driving driver 90*a* in parallel via the current line 91, it is possible to drive other LEDs 81 where the failure does not occur. Therefore, only the LED where the failure occurs is not driven, but other LEDs 81 where the failure does not occur are driven. According to this, it is possible to suppress the decrease of the brightness of the display panel 20, and to maintain the display function even though the failure occurs. LEDs 81 and 82 may be laid out on one surface of the light guide plate 70 in a reticular pattern.

Figure 26:
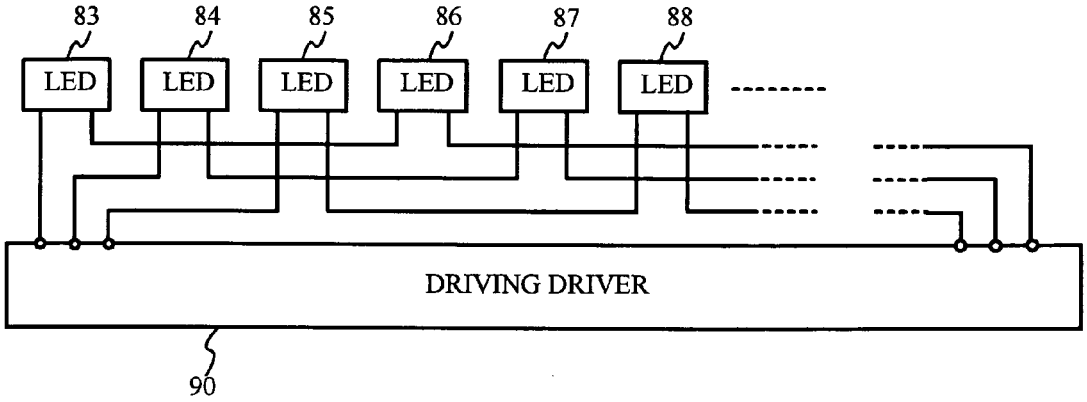
FIG. 26 is a configuration diagram of a backlight in accordance with a second variant example.

A description will now be given of a configuration of a backlight in accordance with a second variant example with reference to FIG. 26.

In the backlight in accordance with the second variant example, as illustrated in FIG. 23A, LEDs are aligned on the one lateral side of the light guide plate 70. In the second variant example illustrated in FIG. 26, LEDs neighboring each other are not connected, and LEDs are connected at intervals. In the example illustrated in FIG. 26, a LED 83 and a LED 86 belong to a group, and are connected by a same wiring, and a cathode of the LED 83 is connected to an anode of the LED 86. In the same manner, a LED 84 and a LED 87 belong to a group, and are connected by a same wiring, and a cathode of the LED 84 is connected to an anode of the LED 87. In addition, a LED 85 and a LED 88 belongs to a group, and are connected by a same wiring, and a cathode of the LED 85 is connected to the anode of the LED 88. According to the connection between LEDs described above, even though a wiring in a certain group is disconnected, as LEDs in other groups light up, the brightness as a whole decreases, but only a certain area of the liquid crystal display 200 does not get dark.

In this second variant embodiment, LEDs 83, 84 and 85 may be laid out on one surface of the light guide plate 70 in a reticular pattern.

Figure 27:
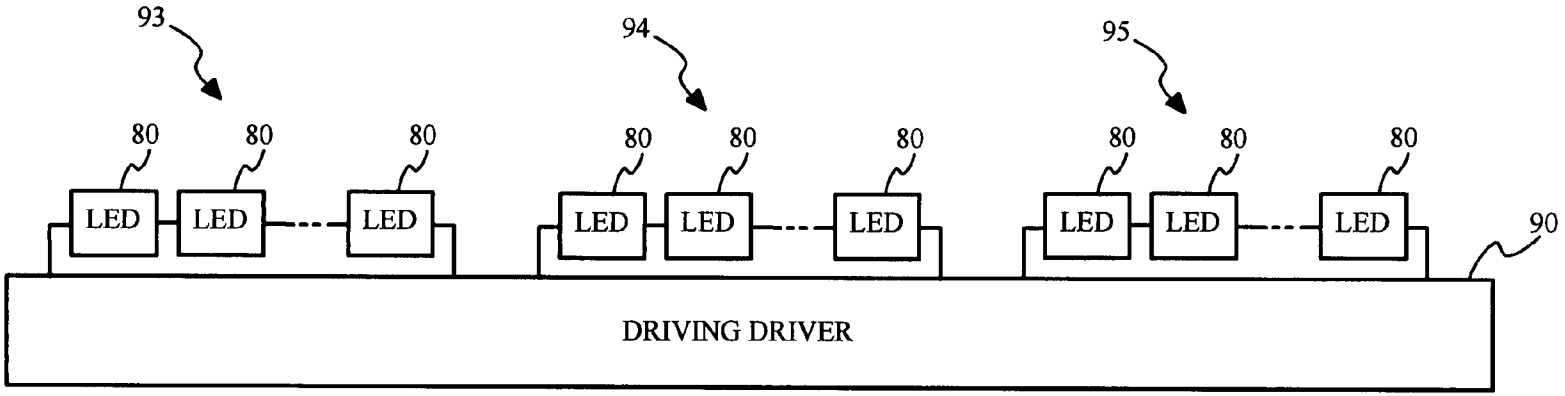
FIG. 27 is a configuration diagram of a backlight in accordance with a third variant example.

A description will now be given of a backlight in accordance with a third variant example with reference to FIG. 27.

In the backlight in accordance with the third variant example, LEDs are aligned on the one lateral side of the light guide plate 70 as illustrated in FIG. 23A. In the third variant example illustrated in FIG. 27, LEDs neighboring each other are connected. This means that a first group 93, a second group 94 and a third group 95 in each of which multiple neighboring LEDs are connected are provided as illustrated in FIG. 27. LEDs in each of groups 93, 94 and 95 are located to correspond to operating ranges of source driver ICs 305*a* through 305*c*. LEDs in each group are connected each other with a same wiring. For example, the driving driver 90 receives an instruction signal from the controller 100 illustrated in FIG. 7, and turns off the first group 93, the second group 94 or the third group 95 in accordance with the source driver IC 305 or the gate driver IC 405 where a failure occurs. For example, when a failure is detected in the source driver IC 305*a* located at the left end illustrated in FIG. 9, the driving driver 90 turns off LEDs in the corresponding first group 93 at the left end based on the notification from the controller 100. In addition, the controller 100 may detect the failure of the LED and its wiring, and stop the operation of the source driver IC 305 and the gate driver IC 405 of the corresponding area. Moreover, LEDs in a corresponding group may be stopped by the control of the driving driver 90 instead of stopping LEDs in the corresponding group by the control of the controller 100. As the driving driver 90 selectively turns off the group of LEDs according to the instruction from controller 100, LEDs in a region where information is not displayed are not turned on, and the power consumption can be reduced.

In the third variant example, LEDs 80 may be laid out on one surface of the light guide plate 70 in a reticular pattern.

Figure 28:
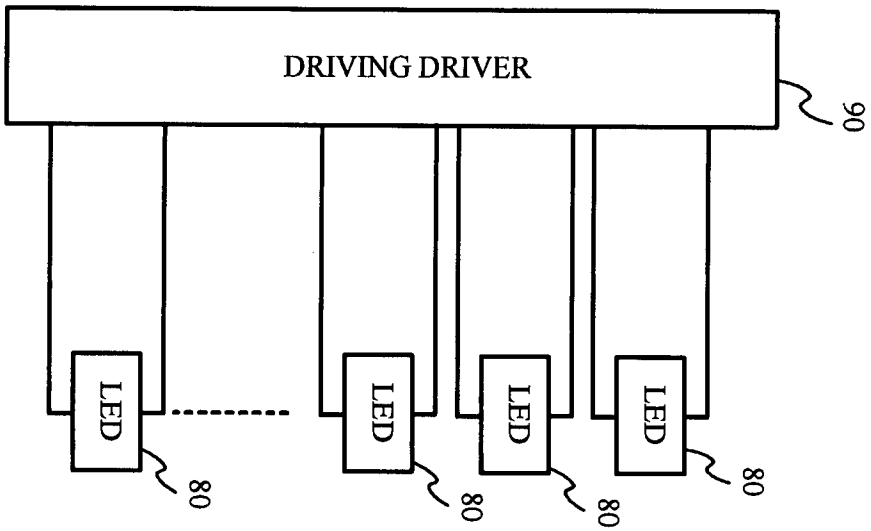
FIG. 28 is a configuration diagram of a backlight in accordance with a fourth variant example.

A description will now be given of a backlight in accordance with a fourth variant example with reference to FIG. 28.

In the backlight in accordance with the fourth variant example, LEDs are aligned on the one lateral side of the light guide plate 70 as illustrated in FIG. 23A. In the fourth variant example illustrated in FIG. 28, LEDs 80 are connected to the driving driver 90 separately, and the driving driver 90 controls the turn-on and turn-off of LEDs 80 in accordance with the instruction from the controller 100. This means that the driving driver 90 is connected to each LED 80 with an individual wiring. Even with this configuration, in the same manner as the third variant example, the region where information is not displayed is not lighted up by LEDs 80, and the power consumption can be reduced.

In the fourth variant embodiment, LEDs 80 may be laid out on one surface of the light guide plate 70 in a reticular pattern.

A description will now be given of a backlight in accordance with a fifth variant example with reference to FIG. 29.

In the backlight in accordance with the fifth variant example, LEDs are laid out on one surface of the light guide plate 70 (the surface opposite to the liquid crystal layer 513) in a reticular pattern instead of aligning LEDs on the one lateral side of the light guide plate 70.

Current detection units 96*a* through 96*s* (s is an arbitrary natural number) that connect anode sides of several LEDs 80 by a same wiring, and detect the current flowing through the connected wiring are provided. In the same manner, current detection units 97*a* through 97*t* (t is an arbitrary natural number) that connect cathode sides of several LEDs 80 by a same wiring, and detect the current flowing thorough the connected wiring are provided.

It is possible to detect the LED 80 which is not turned on by comparing measurement values of current detection units 96*a* through 96*s* and current detection units 97*a* through 97*t*. It is possible to reduce the power consumption by stopping the current supply to the detected LED 80 which is not turned on.

Figure 32:
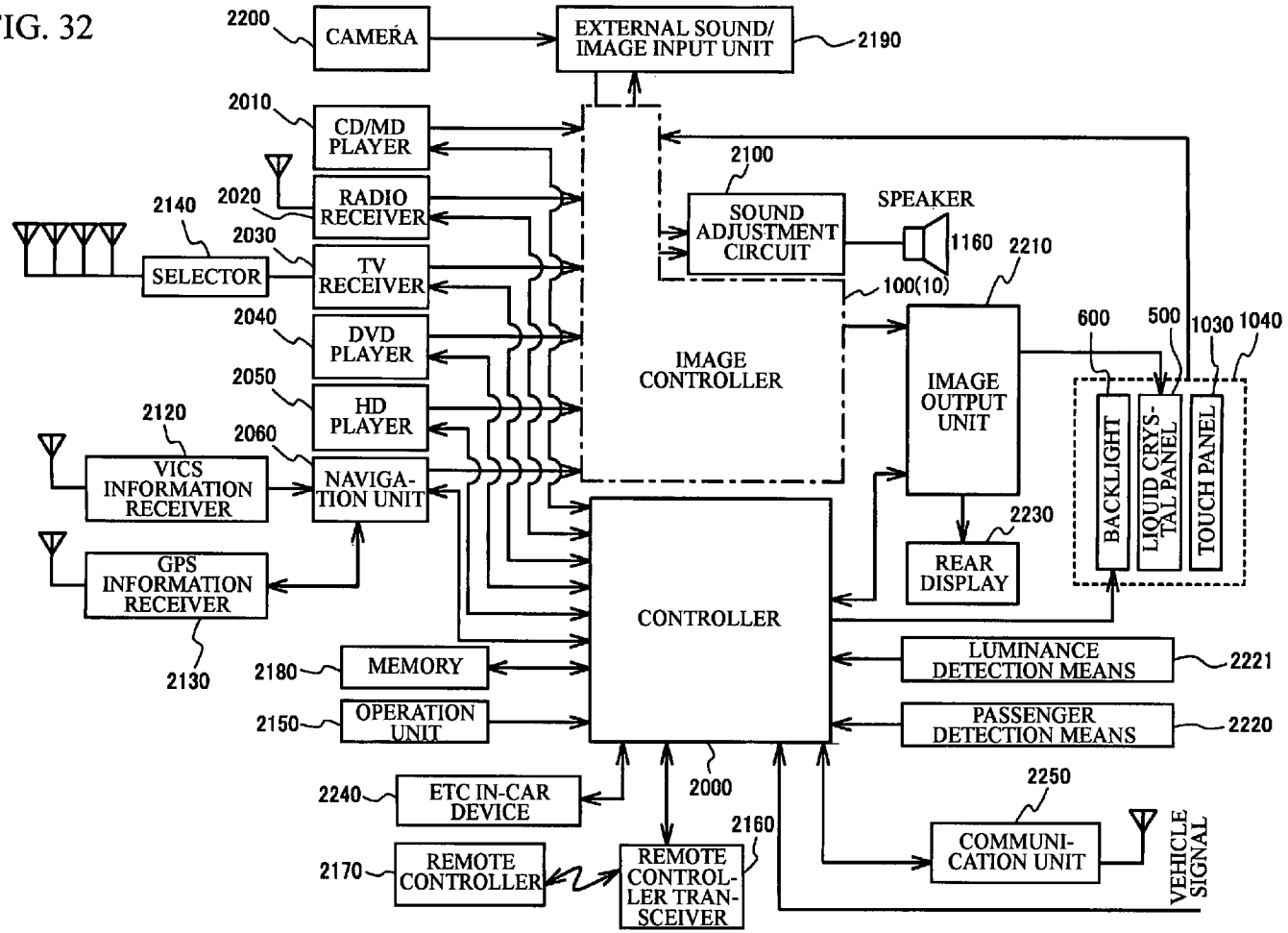
FIG. 32 is a block diagram illustrating a whole configuration of the display device.

FIG. 32 illustrates a whole configuration of the display device 1 (1000). This is an application example to so-called Audio Visual Navigation complex machine. The display device 1 (1000) includes a controller 2000, a CD (Compact Disk)/MD (Mini Disk) player 2010, a radio receiver 2020, a TV receiver 2030, a DVD player 2040, an HD (Hard Disk) player 2050, a navigation unit 2060, an image controller 100 (10) (corresponding to the controller 10 (100) in first and second embodiments described above), a sound adjustment circuit 2100, an image output unit 2210, a VICS (Vehicle Information and Communication System) information receiver 2120, a GPS (Global Positioning System) information receiver 2130, a selector 2140 selecting an antenna, an operation unit 2150, a remote controller transceiver 2160 transmitting/receiving information to/from a remote controller 2170, a memory 2180, an external sound/image input unit 2190, a camera 2200, luminance detection means 2221, a passenger detection means 2220, a rear display 2230, an ETC (Electronic Toll Collection) in-car device 2240, and a communication unit 2250. In many examples of products, the image output unit 2210 and a display unit 1040 are united, and form the display panel, and the present embodiment has such a configuration.

The display unit 1040 is composed of a touch panel 1030, the liquid crystal panel (unit) 500, and the backlight (unit) 600. A flat panel display driven by matrix drive other than the liquid crystal panel (unit) 500, such as an organic EL display panel, a plasma display panel, and a cold cathode flat panel display, may be used for the display unit 1040.

An image synthesizing process, an image scaling process, and an adjustment process of brightness, color tone and contrast are executed to an image from various sources (the CD/MD player 2010, the radio receiver 2020, the TV receiver 2030, the DVD player 2040, the HD player 2050 and the navigation unit 2060) by the image controller 100 (10), and the processed and adjusted image is displayed on the display unit 1040 via the image output unit 2210. The distribution to each speaker 1160, a volume and sound are adjusted in the voice adjustment circuit 2100, and the adjusted sound is output from the speaker 1160.

The controller 2000 receives an operation signal based on the user operation, instruction signals (vehicle signals) from devices and a vehicle, and various signals such as a vehicle speed, a rotation speed of engine, and various alarms, and executes the process, such as an operation control of each component and a setting of contents of image processing, based on such signals. In addition, information reporting the abnormality of the display unit 1040 is input to the image controller 100 (10) from the display unit 1040.

The memory 2180 is formed by a nonvolatile memory and a volatile memory, the nonvolatile memory storing data for executing various processes described later, such as data for determining the priority, the image data for displaying a failure, data for sound control, and parameters for image processing, and the volatile memory being used for various calculating processes. Various programs and data for image processing used by the image controller 100 (10) can be stored in a memory inside the image controller 100 (10) (using a nonvolatile memory), used from the memory 2180 directly, used by transferring data in the memory 2180 to the (volatile) memory inside the image controller 100 (10) at the start-up, or used with the combination of above methods.

Figure 33:
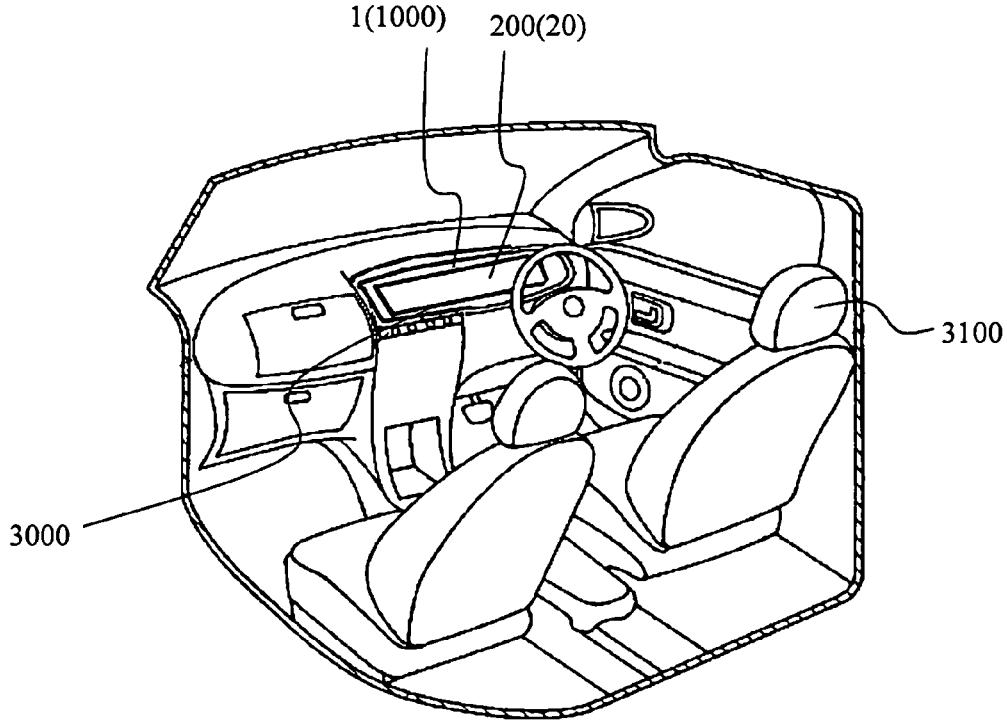
FIG. 33 is a diagram illustrating a mounted location of the display device inside the vehicle.

FIG. 33 is a diagram illustrating a mounting position of the display device 1 (1000) inside the vehicle. The display device 1 (1000) is located from a dashboard 3000 to a driver seat 3100 to display an image for vehicle control such as a speedometer in addition to a car navigation image. When the image for vehicle control such as a speedometer is not displayed, it may be located only in the dashboard 3000. The mounting position of the display device 1 (1000) is not limited to the above location if it is located in the location where the user can see. For example, the display device 1 (1000) may be mounted around a sun visor.

Although a few specific exemplary embodiments employed in the present invention have been illustrated and described, it would be appreciated by those skilled in the art that changes may be made in these exemplary embodiments without departing from the principles and spirit of the invention, the scope of which is defined in the claims and their equivalents.

The timing controller 120 and the image processing unit 110 may be composed of separated CPUs. The source driver circuit 300, the gate driver circuit 400, the timing controller 120, the LED may be provided plurally as illustrated in above embodiments, and their number may be further more.

Figure 30A:
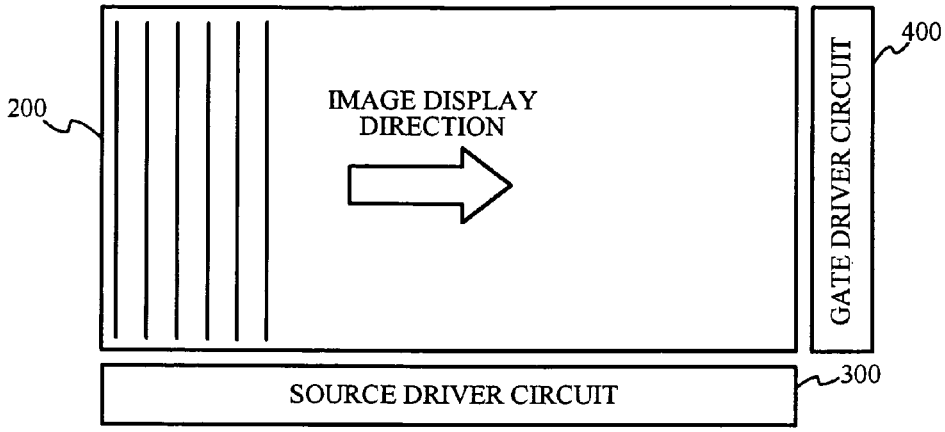
FIGS. 30A through 30C are diagrams for explaining a display direction of an image to the liquid crystal display.
Figure 30B:
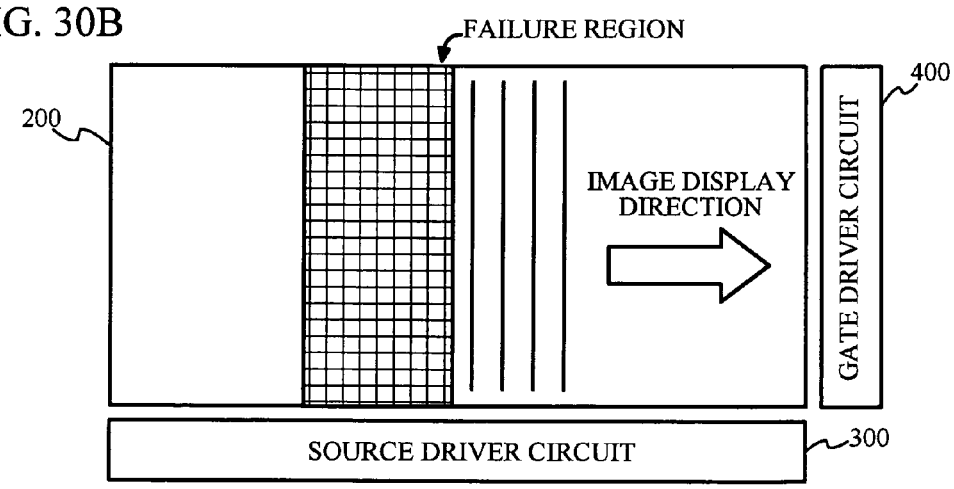
Figure 30C:
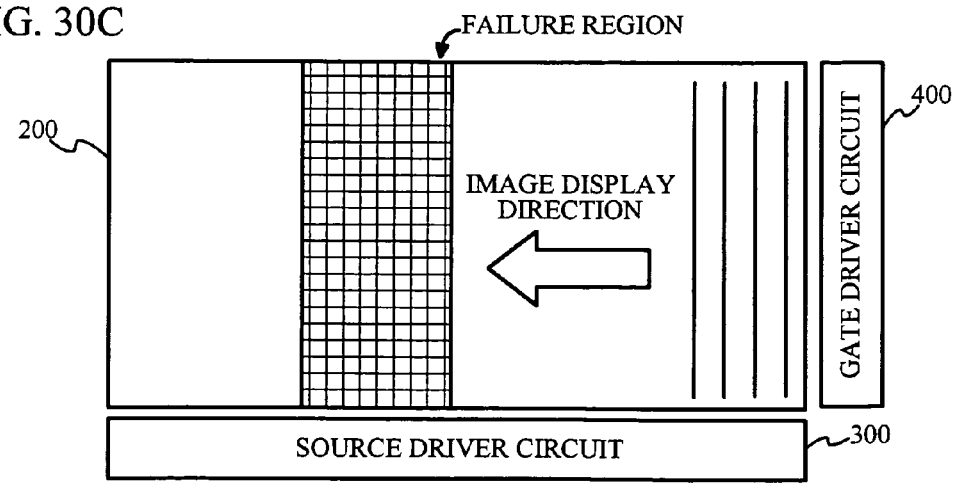

In above embodiments, as illustrated in FIG. 30A, a description was given of a case where the display direction of the image data to the liquid crystal display 200 is from left to right. In addition to this, for example, as illustrated in FIG. 30B, when the failure of the source driver IC 305 is detected at the center region of the liquid crystal display 200, display regions at the left and the right or the center region are compared, and the image data may be displayed from the display region of which the area is larger. In addition, the display direction may be from the right to the left on the screen.

In above embodiment, source driver ICs 305 and gate driver ICs 405 are provided inside the source driver circuit 300 and the gate driver circuit 400, and the region that they handle is divided. Alternatively, information may be displayed in the whole display region of the liquid crystal display 200 by one source driver IC 305 or one gate driver IC 405. In this case, it is necessary that an arbitrary drive circuit 320 is selected from drive circuits 320 provided to the source driver IC 305 (see FIG. 12), and the signal output from the selected drive circuit 320 (e.g. the source start return signal (SSTR), the control signal, and the source data signal (SD)) are output to the controller 100. This applies to the gate driver IC 405.

Figure 31:
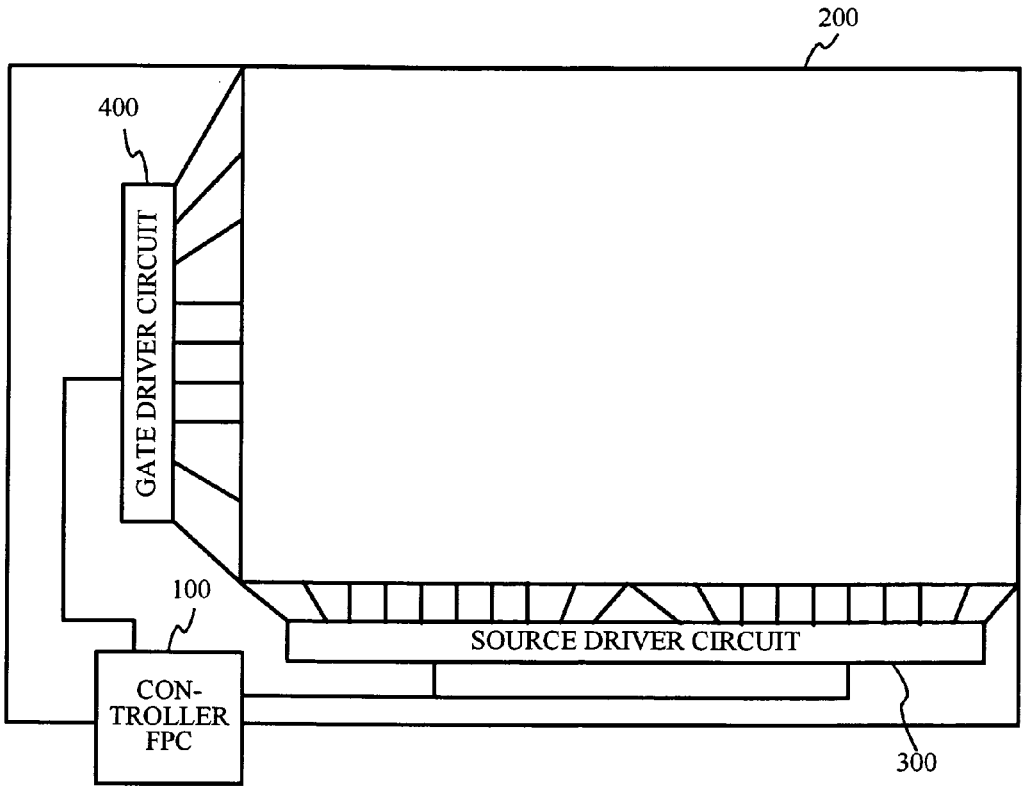
FIG. 31 is a diagram illustrating a configuration of a chip-on-glass type display.

In addition, an LSI chip for driving that includes functions of above-described controller 100, source driver circuit 300 and gate driver circuit 400 may be mounted around the panel substrate by a chip-on glass. FIG. 31 illustrates a state where the LSI chip for driving is mounted around the panel substrate by a chip-on glass.

There is a possibility of the wrong determination because of the effect of noise when a failure in the source driver circuit 300 or the source driver IC 305 is detected with the source start return signal (SSTR) or the source start signal (SST). Thus, it is preferable to set a threshold value for preventing a wrong determination (temporal threshold value, threshold value defining a signal voltage of the source start return signal (SSTR) or the source start signal (SST)), and to determine the failure in the source driver circuit 300 or the source driver IC 305 by a comparison with the threshold value. For example, when the source start return signal (SSTR) or the source start signal (SST) is not received even though the set temporal threshold value is exceeded, the failure of the source driver circuit 300 or the corresponding source driver IC 305 is determined. When the source start return signal (SSTR) or the source start signal (SST) which is larger than the set voltage value is not received, the failure of the source driver circuit 300 or the corresponding source driver IC 305 is determined.

The invention claimed is:

1. A display device that includes a display panel capable of displaying an image, a controller that controls the display panel, and drivers located for driving the display panel, the drivers including a driver which is located in a most previous stage and supplies a data signal to a driver located in a subsequent stage based on a data signal from the controller, and a driver which is located in at least one subsequent stage and supplies a data signal to a driver located in a subsequent stage based on a data signal from a driver located in a previous stage, the display device comprising:

a detection unit that supplies a monitoring signal, which indicates whether a data signal is supplied to the driver located in the subsequent stage normally, to the controller; and a substitution controller that supplies a substitution data signal that substitutes for a data signal supplied to the driver located in the subsequent stage based on a substitution control signal from the controller, wherein the controller supplies a substitution control signal that makes the substitution controller supply a substitution data signal when it determines that a data signal is not supplied as a result of a failure to the driver located in the subsequent stage normally by using the monitoring signal.

2. The display device according to claim 1, wherein the controller determines a displayable region by detecting a failure of the driver by the monitoring signal, generates a display image under abnormal circumstances according to the region, and displays it.

3. The display device according to claim 2, wherein the controller outputs an output stop signal or a black image signal to the driver where a failure is detected.

4. The display device according to claim 1, wherein the controller is comprised of a selector that is located in a previous stage of a driver located in a subsequent stage, switches a data signal and a substitution data signal from a driver located in a subsequent stage and outputs it to the driver located in the subsequent stage.

5. A display device that includes a display panel capable of displaying an image, a controller that controls the display panel, and drivers located for driving the display panel, the drivers including a driver which is located in a most previous stage and supplies a data signal to a driver located in a subsequent stage based on a data signal from the controller, and a driver which is located in a subsequent and operates based on a data signal from a driver located in a previous stage, the display device comprising:

a detection unit that supplies a monitoring signal, which indicates whether a data signal is supplied to the driver located in the subsequent stage normally, to the controller; and a substitution controller that supplies a substitution data signal that substitutes for a data signal supplied to the driver located in the subsequent stage based on a substitution control signal from the controller, wherein the controller supplies a substitution control signal that makes the substitution controller supply a substitution data signal when it determines that a data signal is not supplied as a result of a failure to the driver located in the subsequent stage normally by using the monitoring signal.

6. A display device that includes a group of gate lines and a group of source lines that cross each other, and displays an image by driving image pixels provided between gate lines and source lines in accordance with a source signal at a timing of a gate signal, the display device comprising:

source drivers that are located for driving the group of source lines, and include a source driver located in a most previous stage and supplying a source signal from a controller to a source driver located in a subsequent stage, and a source driver located in at least one subsequent stage and supplying a source signal from a source driver located in a previous stage to a source driver located in a subsequent stage;

a source signal abnormality detection unit that supplies a source monitoring signal, which indicates whether the source signal is supplied normally, to the controller; and a substitution source controller that supplies a substitution source signal that substitute for a source signal supplied to the driver located in the subsequent stage based on a substitution control signal from the controller, wherein the controller supplies a substitution control signal that makes the substitution source controller supply a substitution source signal when it determines that a source signal is not normally supplied as a result of a failure to the driver located in the subsequent stage by using the source monitoring signal.

7. The display device according to claim 6, wherein the controller determines a displayable region by detecting a failure of the source driver by the source monitoring signal, generates a display image under abnormal circumstances according to the region, and displays it.

8. A display device that includes a group of gate lines and a group of source lines that cross each other, and displays an image by driving image pixels provided between gate lines and source lines in accordance with a source signal at a timing of a gate signal, the display device comprising:

source drivers that are located for driving the group of source lines, and include a source driver located in a most previous stage and supplying a source signal from a controller to a source driver located in a subsequent stage, and a source driver located in a subsequent stage and operating based on a source signal from a source driver located in a previous stage;

a source signal abnormality detection unit that supplies a source monitoring signal, which indicates whether the source signal is supplied normally, to the controller; and a substitution source controller that supplies a substitution source signal that substitutes for a source signal supplied to the driver located in the subsequent stage based on a substitution control signal from the controller, wherein the controller supplies a substitution control signal that makes the substitution source controller supply a substitution source signal when it determines that a source signal is not normally supplied as a result of a failure to the driver located in the subsequent stage by using the source monitoring signal.

9. A display device that includes a group of gate lines and a group of source lines that cross each other, and displays an image by driving image pixels provided between gate lines and source lines in accordance with a source signal at a timing of a gate signal, the display device comprising:

gate drivers that are located for driving the group of gate lines, and include a gate driver located in a most previous stage and supplying a start signal, which controls a gate signal from a controller, to a gate driver located in a subsequent stage, and a gate driver located in at least one subsequent stage and supplying a start signal from a gate driver located in a previous stage to a gate driver located in a subsequent stage;

a start signal abnormality detection unit that supplies a start monitoring signal, which indicates whether the start signal is supplied normally, to the controller; and a substitution start controller that supplies a substitution start signal that substitutes for a start signal supplied to the driver in the subsequent stage based on a substitution start control signal from the controller, wherein the controller supplies a substitution control signal that makes the substitution start controller supply a substitution start signal when it determines that a start signal is not normally supplied as a result of a failure to the driver located in the subsequent stage by using the start monitoring signal.

10. The display device according to claim 9, wherein a line supplying the start monitoring signal to the controller and a line supplying the substitution control signal to the substitution start controller are shared by using a bidirectional signal line.

11. The display device according to claim 10, wherein the controller determines a displayable region by detecting a failure of the gate driver by the start monitoring signal, generates a display image under abnormal circumstances according to the region, and displays it.

12. A display device that includes a group of gate lines and a group of source lines that cross each other, and displays an image by driving image pixels provided between gate lines and source lines in accordance with a source signal at a timing of a gate signal, the display device comprising:

gate drivers that are located for driving the group of gate lines, and include a gate driver located in a most previous stage and supplying a start signal, which controls a gate signal from a controller, to a gate driver located in a subsequent stage, and a gate driver located in a subsequent stage and operating based on a start signal from a gate driver located in a previous stage;

a start signal abnormality detection unit that supplies a start monitoring signal, which indicates whether the start signal is supplied normally, to the controller; and a substitution start controller that supplies a substitution start signal that substitutes for a start signal supplied to the driver located in the subsequent stage based on a substitution start control signal from the controller;

wherein the controller supplies a substitution control signal that makes the substitution start controller supply a substitution start signal when it determines that a start signal is not normally supplied as a result of a failure to the driver located in the subsequent stage by using the start monitoring signal.

13. The display device according to claim 12, wherein a line supplying the start monitoring signal to the controller and a line supplying the substitution control signal to the substitution start controller are shared by using a bidirectional signal line.

* * * * *